US010713903B2

(12) United States Patent
Bosak

(10) Patent No.: US 10,713,903 B2
(45) **Date of Patent: *Jul. 14, 2020**

(54) VARIABLE SYMBOL SETS FOR VARIABLE WIN FREQUENCY GAMING

(71) Applicant: ADP GAUSELMANN GMBH, Espelkamp (DE)

(72) Inventor: Wojciech Bosak, Vienna (AT)

(73) Assignee: ADP GAUSELMANN GMBH, Espelkamp (DE)

( * ) Notice: Subject to any disclaimer, the term of this patent is extended or adjusted under 35 U.S.C. 154(b) by 0 days.

This patent is subject to a terminal disclaimer.

(21) Appl. No.: 16/290,467

(22) Filed: Mar. 1, 2019

(65) Prior Publication Data

US 2019/0304260 A1 Oct. 3, 2019

Related U.S. Application Data

(63) Continuation of application No. 15/942,370, filed on Mar. 30, 2018, now Pat. No. 10,223,873.

(51) Int. Cl.
*G07F 17/32* (2006.01)
*G07F 17/34* (2006.01)

(52) U.S. Cl.
CPC ..... *G07F 17/34* (2013.01); *G07F 17/323* (2013.01); *G07F 17/3209* (2013.01); *G07F 17/3211* (2013.01); *G07F 17/3267* (2013.01)

(58) Field of Classification Search
CPC ..... G07F 17/32
See application file for complete search history.

(56) References Cited

U.S. PATENT DOCUMENTS

2009/0298573 A1 12/2009 Bramble
2015/0339880 A1 11/2015 Zurawski et al.

*Primary Examiner* — Omkar A Deodhar
(74) *Attorney, Agent, or Firm* — Resolute Legal PLLC

(57) ABSTRACT

A gaming system and method are disclosed as having different symbol sets associated with different win rates that are combined to create variable win frequency gaming. The gaming system may include a plurality of reel strip sets. Each reel strip set may include a plurality of reel strips. Each reel strip set may have a different probability of achieving a predetermined outcome. After a predetermined outcome on the gaming system is generated, the gaming system may select a different reel strip set having a different probability of achieving a predetermined outcome. In some embodiments, the selected new reel strip set may have a higher probability of achieving a predetermined outcome than the current reel strip set. The higher probability of achieving a predetermined outcome increases the chance that the subsequently played game(s) will also result in achieving a predetermined outcome for the player.

20 Claims, 10 Drawing Sheets

VARIABLE SYMBOL SETS FOR VARIABLE WIN FREQUENCY GAMING

RELATED APPLICATIONS

The present application claims priority under 35 U.S.C. § 120 as a Continuation of prior U.S. patent application Ser. No. 15/942,370, filed Mar. 30, 2018, whose entire disclosure is hereby incorporated by reference.

FIELD OF THE INVENTION

The present disclosure relates to video gaming devices.

SUMMARY OF THE INVENTION

In various embodiments, a gaming system and method are disclosed as having a plurality of different symbol sets where the different symbol sets are each associated with different hit (win) rate frequencies. By varying the symbols sets used for different plays of a game, the gaming system can alter how frequently a player wins a game. In some embodiments, by using symbol sets with low hit rate frequencies for some plays of a game combined with symbol sets with high hit rate frequencies for other plays of the game, the gaming system can increase the chance that sequential plays of a game will result in winning outcomes. These increased chances of creating winning outcomes for sequential plays of a game creates clusters of winning "streaks".

In one such embodiment, the gaming system may include a plurality of symbol sets. Each symbol set may include a plurality of different symbols. Each symbol set may be associated with a different probability of achieving a predetermined outcome. The gaming system may select a first one of the plurality of symbol sets to use to generate symbols for a play of a game. Based on the outcome of the play of the game, the gaming system may select a different symbol set associated with a different probability of achieving the outcome. In some embodiments, the selected new symbol set may have a higher probability of achieving the outcome than the previously used symbol set. The higher probability of achieving the outcome increases the chance that the subsequently played game(s) will also result in achieving the outcome for the player. The gaming system may select another symbol set when the gaming system generates a different outcome. The other symbol set may have a lower probability of achieving the outcome than the previously selected symbol set.

In various embodiments, the symbol sets may include sets of reel strips. The gaming system may include a plurality of reel strip sets. Each reel strip set may include a plurality of reel strips, where each reel strip includes a plurality of symbols associated with a reel of the gaming system. Each reel strip set may have a different probability of achieving a first predetermined outcome. In one embodiment, the first predetermined outcome is a winning outcome. If the gaming system generates the first predetermined outcome, the gaming system may select a different reel strip set having a different probability of achieving a first predetermined outcome. In some embodiments, the selected new reel strip set may be associated with a higher probability of achieving the first predetermined outcome than the prior reel strip set. The higher probability of achieving the first predetermined outcome increases the chance that the subsequently played game(s) will also result in achieving the first predetermined outcome for the player. The gaming system may select another reel strip set upon the occurrence of a second predetermined outcome. In one embodiment, the second predetermined outcome is a non-winning outcome. The other selected reel strip set may have a lower probability of achieving a first predetermined outcome than the immediately prior reel strip set. It should be appreciated that a winning outcome, in one embodiment, may include outcomes resulting in any amount of award or value being returned to the player. In one embodiment, a winning outcome may include outcomes resulting in a predetermined amount or greater of award or value being returned to the player. It should be appreciated that outcomes other than winning outcomes and non-winning outcomes are contemplated. In one embodiment, a predetermined outcome may include a particular symbol or symbol combination being generated by the gaming system.

In one embodiment, the gaming system and method having variable symbol sets for variable win frequency gaming includes a plurality of reel strip sets. The plurality of reel strip sets may include a first reel strip set and a second reel strip set. Each reel strip set may include a plurality of reel strips, where each reel strip includes a plurality of symbols associated with a reel of the gaming system. Each reel strip set may have a different hit rate frequency. In one embodiment, the gaming system may have two reel strip sets. In other embodiments, the gaming system may have three or more reel strip sets. Further, each reel strip set may have identical or nearly identical return to player (RTP) values. After a winning outcome on the gaming system is generated, the gaming system selects a different reel strip set from the plurality of reel strip sets. In some embodiments, the selected new reel strip set may have a higher hit rate frequency than the prior reel strip set. The higher hit rate frequency reel strip set increases the chance that the subsequently played game(s) will also result in winning outcomes for the player. Upon the occurrence of a non-winning outcome, the gaming system may select a reel strip set having a hit rate frequency that is lower than the prior selected reel strip set. In this manner, the gaming system may select and utilize a different reel strip set from a plurality of reel strip sets to vary the player experience with the gaming system.

In one embodiment, the gaming system may have a first plurality of reel strip sets and a second plurality of reel strip sets. The gaming system may randomly select a first reel strip set from a first plurality of reel strip sets for a play of a game if the outcome of the previous game did not generate a winning outcome. The gaming system may continue to randomly select a first reel strip set from a first plurality of reel strip sets for each game until a winning outcome is generated by the gaming system. For a subsequent game after a winning outcome is generated, the gaming system may select a second reel strip set from a second plurality of reel strip sets to apply to the reels of the gaming system. The second plurality of reel strip sets contain second reel strip sets that have a higher hit rate frequency than the first reel strip sets contained in the first plurality of reel strip sets. The gaming system may continue play utilizing a second reel strip set selected from the second plurality of reel strip sets until an occurrence of a non-winning outcome. Upon the occurrence of a non-winning outcome, the gaming system may return to randomly selecting a first reel strip set from a first plurality of reel strips sets. In this manner, when a winning outcome is generated, the gaming system increases the likelihood of obtaining a winning outcome in the subsequent game and thereby providing a greater likelihood of the player experiencing a winning streak.

DETAILED DESCRIPTION OF THE INVENTION

Figure 1:
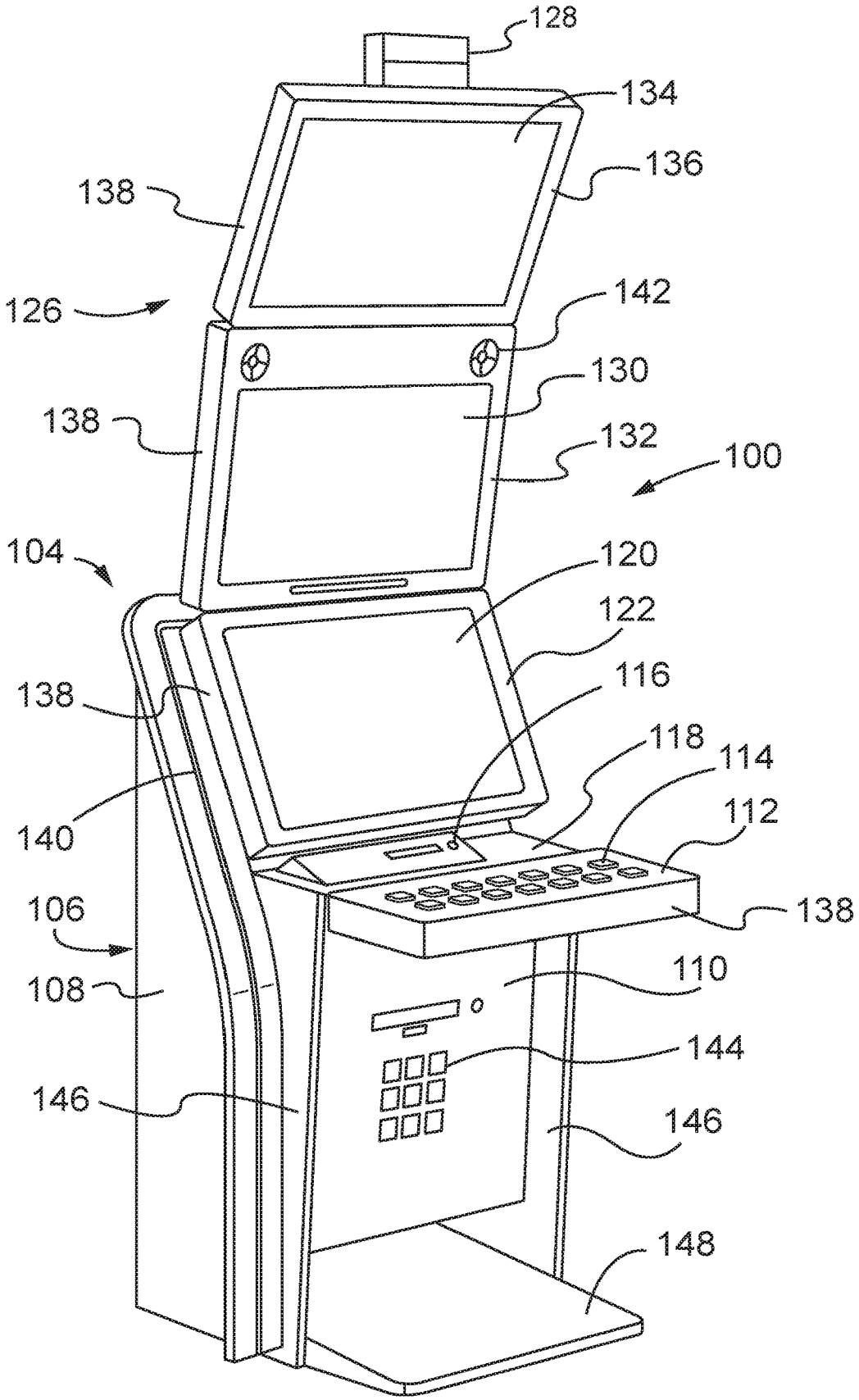
FIG. 1 is a perspective view of an embodiment of a stand-alone gaming device of a gaming system.

Various embodiments of a gaming system and method are disclosed as having variable reel strips, (i.e., varying symbol sets) for providing variable win frequency. The gaming system includes a plurality of reel strips sets. A reel strip defines the symbols and the symbol distribution utilized in the play of a video reel wagering game. The symbol distribution may alternatively be viewed as weights or probabilities associated with each of the symbols of being generated in a play of a game on the gaming system. It should therefore be appreciated that the gaming system does not require physical reel strips. A reel strip set defines all reel strips necessary for an execution of a game. Each reel strip set may be characterized by a hit rate frequency value and a return to player (RTP) value. The reel strip sets may be grouped into a first reel strip set and a second reel strip set. In some embodiments, the reel strip set may be grouped into a first plurality of reel strip sets and a second plurality of reel strip sets. The reel strip sets grouped in the first plurality of reel strip sets may have a lower hit rate frequency value relative to the reel strip sets grouped in the second plurality of reel strip sets. The reel strip sets grouped in the second plurality of reel strip sets may have a higher hit rate frequency value relative to the reel strip sets grouped in the first plurality of reel strip sets.

In an embodiment of one method of operating the gaming system, the gaming system may receive a monetary value from a player via a value acceptor device. The gaming system may determine, via a processor of the gaming device, a credit balance based on the monetary value received. The gaming system may receive, via a player input device, a wager for a play of a game at the gaming device. The gaming system may use a processor of the gaming device to update a gaming credit balance in accordance with the amount of the wager. The gaming system may determine the outcome of the last game played on the gaming system. The gaming system may select a reel strip set from one of a plurality of reel strips sets based upon the outcome of the last game played on the gaming system. If the outcome of the last game played on the gaming system was a non-winning outcome, the gaming system may select a reel strip set from a first plurality of reel strip sets having a low hit rate frequency value. If the outcome of the last game played on the gaming system was a winning outcome, the gaming system may select a reel strip set from a second plurality of reel strip sets having a higher hit rate frequency value than the first plurality of reel strip sets. The gaming system may receive, via a player input device, a request to initiate a play of the game. The gaming system may use a random number generator to randomly generate a plurality of symbols from the reel strip for each game reel, based upon the reel strip set selected. The gaming system may display the randomly generated plurality of symbols in a visible symbol display area. The gaming system may then evaluate, by the processor of the gaming system, the displayed symbols for winning symbol combinations along wagered pay lines. The gaming system may update, by the processor of the gaming system, the gaming credit balance in accordance with any award amount based on the winning symbol combinations. The gaming system may dispense a value to the player via a value dispenser of the gaming system in accordance with the player gaming credit balance when receiving a signal to cash out or otherwise end the gaming session at the gaming system.

Gaming Device Platform

The features and advantages of the gaming system and method described herein may be provided to a player via a gaming device platform that includes various structures and components for allowing player interaction with the gaming device. While only one gaming device platform will be described in detail herein, the features, objects, and advantages of the gaming system described herein may be implemented in one or more alternative gaming device platforms.

One embodiment of a gaming device platform is shown in FIG. 1 where a gaming device 100 is generally shown. In one embodiment, the gaming device 100 is referred to as a slot machine and is illustrated as housed in a housing or cabinet constructed so that a player can operate and play the gaming device 100 while standing or sitting.

Gaming device 100 may include cabinet 104 for housing the components fully described hereinbelow. The cabinet 104 has a lower cabinet body portion 106 which includes a pair of cabinet side panels 108 (only one of which is viewable in the perspective view of FIG. 1), front panel 110, and a rear panel (not shown). A base panel (not shown) and a top panel surface (not shown) that supports first game display 120 and the player interaction area 112, are provided. The cabinet panels are interconnected along their edges and cooperate to form a cabinet enclosure for housing the gaming device, as can be seen in FIG. 1.

It should be appreciated that a wide variety of cabinet enclosure sizes, shapes, and designs are possible for the gaming device 100. Cabinet 104 may function to securely protect any local control system, technology components, and provide support for game display(s) and player input and output interactions with the gaming device.

Returning to FIG. 1, the gaming device enables the player to interact with the gaming device 100 to direct the wagering and game play activities and preferences. Various forms of player interaction devices and activities will now be described.

Cabinet 104 includes a player interaction area having input and output areas generally designated as 112. The player interaction area 112 may be located on the front top side of cabinet 104 and, as shown, on a panel structure that extends outwardly from the gaming device in a player's direction. Player interaction area 112 may contain a plurality of player input and output structures such as player control button area 114, player value acceptor and dispenser area 116, and player convenience input area 118.

Player control button area 114 includes a plurality of buttons, touch sensitive areas, or both through with which players may interact with the one or more processors of gaming device 100 and direct game play. It is expected that cabinet 104 provides an easily accessible location and support for all necessary player input/output (I/O) interactions with the device, including gaming control interactions and value wagering interactions. Although the gaming device 100 illustrated in FIG. 1 shows player controls provided by buttons of player control button area 114, it is understood that in one embodiment, a player's gaming control interactions could be made by either button mounted on cabinet 104 or "soft" buttons located on the gaming display and activated by player touch (e.g., touch screen interfaces), or a combination of both arrangements.

Player control button area 114 may include, for example: game selection button(s) in any embodiments where more than one game is provided in a single gaming device; gaming denomination value selection button(s) in any embodiments where one or more wagering denomination value is accommodated; wager selection button(s) for the player to indicate or select the desired wager value for a game in any embodiments where a selection of wager values are offered; pay line selection button(s) for selecting the number of active pay lines in game embodiments that provide multiple pay line wagering; a reel spin button for players to initiate one or more reels to spin in a game; a repeat last bet button for players to conveniently repeat the last game's preference and wager selections in a new game; a cash-out button for player extraction of gaming device credits; an attendant call button; and gaming device information buttons such as show pay tables, show game rules, or show other game-related information. As discussed above, the functions of the buttons in player control button area 114 may be duplicated with soft buttons in the player control button area 114 or as soft buttons in other areas of the gaming device 100 (e.g., as a touch screen overlay over available game displays).

Gaming device 100 may include one or more forms of value acceptance and value distribution to allow the player to interact with the device and to risk or otherwise place a wager (a monetary value) on one or more outcomes of a game. Winnings may be returned to the player via some form of value distribution. As illustrated in FIG. 1, player value acceptor and dispenser area 116 is provided. In the player value acceptor and dispenser area 116, a player supplies monetary value to the gaming device 100 via one or more value acceptor devices. In one embodiment, the player value acceptor and dispenser area 116 (through the one or more value acceptor devices) may accept any one or more of the following from a player to establish a gaming credit balance: coins, bills, tokens, tickets/vouchers, player ID cards, credit cards, or other suitable forms of value. Thus, if the gaming device 100 accepts coins and bill, the gaming device 100 includes a currency bill validator and a coin validator as the value acceptor devices. Likewise, if the gaming device 100 accepts tickets, the gaming device includes a ticket acceptor as a value acceptor device for receiving tickets or vouchers representing some monetary value. The ticket acceptor may include a bar code reader, or other appropriate code reader, for reading the encoded value contained by the player's ticket or voucher. In some embodiments, the player value acceptor and dispenser area 116 may include a value acceptor device that can accept more than one type of value. In some embodiments, the player value acceptor and dispenser area 116 may include multiple different value acceptor devices to accept different types of value from players Upon receipt of some type of value from the player, a value acceptor device of the player value acceptor and dispenser area 116 performs validation on the player supplied value using appropriate hardware readers (e.g., determining that the currency bills/coins/tokens are genuine or the ticket/voucher is genuine). If the validation result is positive on player supplied value, the appropriate value acceptor device generates a signal to a processor of the gaming device 100 to establish a gaming credit balance for plays of one or more games on gaming device 100.

In one embodiment, a player receives monetary value, or a representation thereof, from the gaming device 100 when a player chooses to "cash out" the gaming credit balance (e.g., remove value from the gaming device 100). The player can cash out at any suitable time. When a player cashes out the value contained on a credit meter (not shown) of gaming device 100, a processor of gaming device 100 may cause a printer of gaming device 100 to print and dispense a coded ticket or voucher through a dispensing slot to the player. The coded ticket or voucher may be a bar-coded ticket or any other suitable code (PDF417 coding or quick response (QR) coding). This ticket can then be used as value input at another gaming device, or converted to currency at a conveniently located kiosk or cashier counter located near the gaming device. Alternatively, the processor of gaming device 100 may cause a currency bill dispenser or a coin dispenser in gaming device 100 to dispense the value contained on the credit meter of gaming device 100.

Various combinations of the above value acceptance and value distribution arrangements are possible. Gaming device 100 may include other value acceptance and value distribution mechanisms in the player value acceptor and dispenser area 116. For example, gaming device 100 may include a magnetic strip or chip card reader/writer in order to accept value from and transfer value to a magnetic strip or an embedded chip card. In other embodiments, hardware for transferring (and receiving) non-traditional currencies to players such as digital currencies (e.g., bitcoin) may be included in gaming device 100.

In an alternative embodiment, gaming device 100 may include a card reader (not illustrated) in the in the player value acceptor and dispenser area 116, which accepts and reads any of a variety of magnetic strip or imbedded chip smart cards that convey machine readable information. The card reader reads inserted cards, in the case of wagering, for the credit information of the player for cashless gaming. The card reader may, for player loyalty programs, utilize the information on the card to identify the player account associated with the card so the gaming activity on the gaming device may be associated with the player account. It is noted that a numeric or alphanumeric keypad may be provided adjacent to the card reader slot to enable player entry of a personal identification number or the like for secure access to card information.

In one embodiment, a player convenience input area 118 may be included in the gaming device 100, as is shown in FIG. 1. In various embodiments, player convenience input area 118 may have a variety of features and functions depending on the jurisdictional deployment of the gaming device 100. In one embodiment, the player convenience input area 118 will house a magnetic strip card reader (not illustrated), integrated circuit chip card reader (not illustrated), or both, for reading cards associated with a player loyalty program. Player loyalty programs, also referred to as player tracking systems, provide magnetic strip or chip cards to players for insertion into a gaming device during play. These player loyalty/player tracking cards are associated with a player account and are utilized by the card-issuing entity to monitor, or track a player's gaming activity and build loyalty through player rewards of a variety of types. The player convenience input area 118 may include an input mechanism such as input buttons so that a player may input a personal identification number or other require player information associated with the player tracking card. Further, the input mechanism may also include a small display utilized to communicate player information to the player such as the player's current loyalty rewards.

In certain embodiments, the player convenience input area 118 may include player convenience features such as a pocket for storage that allows players to store their personal items such as a mobile phone. Gaming device 100 may include one or more universal serial bus (USB) ports that enables a player to charge their electronics or connect to services such as the Internet or food service. Further, player convenience input area 118 of gaming device 100 may include buttons to request food or drink service if the gaming device is located in an establishment that has food and drink service. The gaming device 100 may be connected to a local or wide area network such that selection of the requested food or drink service will alert the establishment's hospitality staff to deliver the requested service directly to the gaming device 100.

The layout of the player control button area 114, player value acceptor and dispenser area 116 and the player convenience input area 118 in gaming device 100 may be arranged differently than those disclosed and illustrated herein. The selections and arrangement of input features and locations on the cabinet 104 may be dependent upon the game buttons, the type of value wagered, and the player conveniences utilized in the deployment configuration of gaming device 100.

With continuing reference to FIG. 1, in one embodiment, lower cabinet body portion 106 includes a first game display 120 mounted atop or flush with the lower cabinet body portion's top panel surface. First game display 120 is, for example, a 27-inch liquid crystal display (LCD) display mounted in a widescreen orientation. However, any suitable display may be used in any suitable orientation. In the illustrated embodiment, the first game display 120 is mounted within and framed by first display frame 122 which is, in turn, mounted upon lower cabinet body portion's top panel surface. In this manner, the first game display 120 is both surrounded and secured within the first display frame 122 and raised above the cabinet's top panel surface. Additional features of the first display frame 122 will be described below. In one embodiment, gaming device 100 may use one first game display 120 and not include additional game displays (not illustrated).

The lower cabinet body portion 106 is further constructed to support upper cabinet portion 126. Upper cabinet portion 126 may be comprised of an upwardly extending support structure (not illustrated) that extends upwardly from the rear side of lower cabinet body portion 106 and is sufficiently strong to support one or more additional game displays.

At the topmost end of the support structure, a cabinet top light 128 may be provided. The cabinet top light 128 is capable of illumination in a variety of colors and is utilized to indicate and communicate gaming device conditions to gaming players and service personnel.

Further, the upper cabinet portion support structure may conceal power and communication lines between (1) the control systems and components located within the lower cabinet body portion 106 and (2) the displays mounted on the upper cabinet portion 126 support structure.

In one embodiment, as illustrated in FIG. 1, gaming device 100 includes two additional displays, second game display 130 and third game display 134. Second game display 130 and third game display 134 are disposed generally in a vertical relationship and generally in alignment with the first game display 120. Like the first game display 120, second game display 130 and third game display 134 can be 27-inch LCD displays and can be mounted in a widescreen orientation in one embodiment. However, any suitable display in any suitable orientation may be used for the second game display 130 and the third game display 134. Further, like the first game display 120, second game display 130 and third game display 134 can be mounted within and framed by second display frame 132 and third display frame 136, respectively. Second display frame 132 and third display frame 136 are attached to the upper cabinet support structure and can protect the second game display 130 and the third game display 134.

First game display 120, second game display 130, and third game display 134 can be disposed at an angle from each other to form a player-facing concave arc. However, in some embodiments, the angles between the displays may be adjustable and may be smaller or greater than the angles illustrated in FIG. 1. Further, it is understood that in some embodiments the displays may be disposed in a common plane relative to each other.

It also should be appreciated that in various embodiments a variety of display technology may be utilized equivalently and interchangeably with a variety of embodiments of the gaming device. Equivalent display devices include all variations of liquid crystal displays, light emitting diode displays, and plasma displays.

In some embodiments, different sized displays may be combined to display gaming data on gaming device 100. As a non-limiting example, a 27-inch widescreen LCD display may be combined with a 20-inch portrait oriented LCD or a light emitting diode (LED) display. This combination may be used, for example, with a third scrolling banner LED display. In alternative embodiments, one, two, three, or more displays could be used in a variety of positions and orientations. Any suitable combination may be used. It should also be appreciated that a processor of gaming device 100 may communicate with the disclosed first game display 120, second game display 130, and third game display 134 through a video card of gaming device 100 to produce the visible aspects of a game.

In one embodiment, one or more of the first game display 120, second game display 130, and third game display 134 may be fitted with a transparent touch sensitive overlay for sensing player touch inputs into the gaming device. Touch sensitive overlays can communicate with a processor of gaming device 100 to enable the player to interact with the game.

In some embodiments, the curved displays may be used for any or all of the first game display 120, second game display 130, or third game display 134. Similarly, any of the displays used for gaming device 100 can be based on flexible display technologies. For example, it is possible to utilize flexible display technologies to create uniquely shaped curving, wavy, or tubular display structures to provide one or more of the first game display 120, second game display 130, and third game display 134. Additionally, in one embodiment flexible display technologies can be used in combination with fixed flat screen technologies.

While the gaming device 100 has been described as implemented with video technologies, in one embodiment, mechanical reels with reel strips containing game indicia and step motor controllers may be employed to provide game information to a player. In one embodiment, the reel strips may include a plurality of printed symbols. In another embodiment, the mechanical reels may include flexible video display technology as the reel strips on mechanical reels. Thus, games implemented in video form can readily be implemented with mechanical reels utilizing such display technology. Alternatively, in other embodiments mechanical reels with reels strips having fixed symbols displayed along the reel strip could be used to implement the game.

Dependent upon the particular gaming device housing style, a variety of other display technologies may be utilized in combination with the gaming device disclosed herein. For example, in some embodiments a gaming device may have one or more display devices in addition to the main game display(s). For example, the gaming device may include a player tracking device having a player tracking display which displays various information to the player regarding the player's status. The gaming device may also include other game-related displays such as the wager display and the gaming credit balance display. These additional game-related displays may be separate display devices or may be displayed on any one or more of the first game display 120, the second game display 130, or the third game display 134.

Cabinet lighting design functions to attract players to a gaming device 100. In the embodiment of FIG. 1, attractive cabinet lighting is provided by frame accent lighting 138. It is noted that frame accent lighting 138 is a common structure found on each of the first display frame 122, the second display frame 132, and the third display frame 136 and player interaction area 112. Example areas where frame accent lighting is applied to gaming device 100 are commonly designated as frame accent lighting 138.

Frame accent lighting 138 may have multiple components. The side edge pieces of first display frame 122, second display frame 132, third display frame 136, and the edge structure of player interaction area 112 can be made of a translucent or transparent plastic or other suitable materials. Linear arrays, or strips, of light emitting diodes (LEDs) (not shown) on circuit boards may be mounted below the translucent or transparent plastic side edge pieces 138. In one embodiment, the circuit boards are flexible circuit boards. These LED strips and transparent or translucent coverings may surround one or more gaming device displays frames, as well as the player interaction area, to highlight these areas.

In one embodiment, the individual LEDs mounted on the LED strips are of a type that can emit red, green, and blue light. In an alternative embodiment, separate LEDs are used for each required light color. All LED strips can be electrically connected and can be controlled by a cabinet lighting controller 218 (illustrated in FIG. 2) in conjunction with a processor of gaming device 100 to selectively mix the emitted light colors in a manner to create any color. The cabinet lighting controller 218 can flash and vary lighting as desired. For example, cabinet edge lighting can change and flash in combination with music rhythms or in combination with game events. Other variations are possible.

In some embodiments, cabinet 104 may include LED strip lighting or LED rope lighting to accentuate the cabinet and enhance the attractiveness of gaming device 100 to players. LED rope lighting is a plurality of small light-emitting diode bulbs linked together and encased in a plastic, polyvinylchloride, or other suitable material to create a string of lights. For example, in the embodiment of FIG. 1, cabinet 104 includes cabinet accent lighting 140. In one embodiment, cabinet accent lighting 140 is LED rope lighting mounted flush with the front side edge of the cabinet side panels 108. The LED rope lighting can generate any of suitable colors, and are controlled by cabinet lighting controller 218 and a processor of gaming device 100 to selectively mix the emitted light colors in a manner to create any color in the same manner as the frame edge lighting.

In various embodiments, gaming device 100 includes one or more audio speakers and appropriate driving electronics and sound cards so that game players may experience pleasing audio aspects of the gaming device 100. Audio is desirable to attract and maintain player interest in gaming device 100. Gaming device 100 may also emit attraction sounds during any idle period of gaming device 100. Game audio may add to the player's enjoyment of gaming device 100 by providing music and sound effects designed to enhance and compliment the gaming experience.

Audio speaker hardware may include one or more speakers disposed in or on the cabinet 104 of gaming device 100. In FIG. 1, a pair of audio speakers 142 are shown mounted on the upper corners of second display frame 132. Any suitable number of additional speakers may be provided on additional display frames or on the lower cabinet body portion 106 as desired.

Speakers designed for emitting bass vibrations may be included in some embodiments.

Speaker placement may be selected to enhance the sound emitting characteristics of the gaming device. For example, bass speakers or additional speakers 144 may be mounted inside lower cabinet body portion 106. Further, it is envisioned that in some embodiments sound processing such as multichannel processing and surround sound processing are included in gaming device 100. Audio jacks for attachment of player headphones may also be provided in some embodiments of gaming device 100 for the player to further enhance the audio experience of the game and also to block out noise from other gaming devices.

In one embodiment, front panel 110 of lower cabinet body portion 106 includes a locked removable panel or locked door (not shown), which can be opened for access to internal control system and technology components that are housed within lower cabinet body portion 106 (discussed hereinbelow with respect to FIG. 2). Front panel 110 may be flanked on vertical sides by cabinet side panel extensions 146 which serve to define a space below player interaction area 112 for players to place their feet and legs while they are playing gaming device 100 in a seated position. Foot rest 148, which may be cushioned, is provided below player interaction area 112 to enhance a player's ergonomic comfort while playing gaming device 100. In one embodiment, the edges of player interaction area 112 may be ergonomically cushioned as well.

Gaming device 100 may be embodied in alternative gaming device housing forms and styles. For example, the housing may have fewer or greater number of display areas for displaying the game and game-related information to the player. If multiple displays are used, the displays may be of similar size, shape, and orientation or the displays may be divergent from each other in one or more of their respective descriptive characteristics. The one or more displays can be supported by, mounted upon, or housed within a cabinet 104 which can comprise a variety of shapes, sizes, and forms. The cabinet 104 can 1) protect and house the operational electronics, 2) adequately support the display(s) in a position easily viewable for a seated or standing player, as necessary 3) provide an easy location and support for all necessary player input/output (I/O) interactions, including gaming control interactions and value wagering interactions. For example, in some embodiments the gaming device 100 may be disposed in a housing style referred to as a "slant top" gaming device that is designed to be operated with the player comfortably seated. In this arrangement, generally, the gaming display(s) and all player I/O controls are located on a low, wide, surface that extends forwardly from the player on a horizontal plane and then slopes upwardly and away from the player's seated location.

In one embodiment, housing styles of cabinet 104 of gaming device 100 may include bar top or table top housing arrangements. These housings are generally small enough to be placed on top of an existing bar or table while providing the requisite gaming device housing features of protection of/access to gaming electronics, displays, and player I/O features described above.

In one embodiment, cabinet 104 may be an embedded housing. Embedded housings are built into structures designed to otherwise function as bars or tables in a gaming environment. Displays may be integral with the bar top or table top surface or the entire unit may be contained below a transparent bar or table top surface while controls are disposed on the lower front or side of the bar or table.

Figure 2:
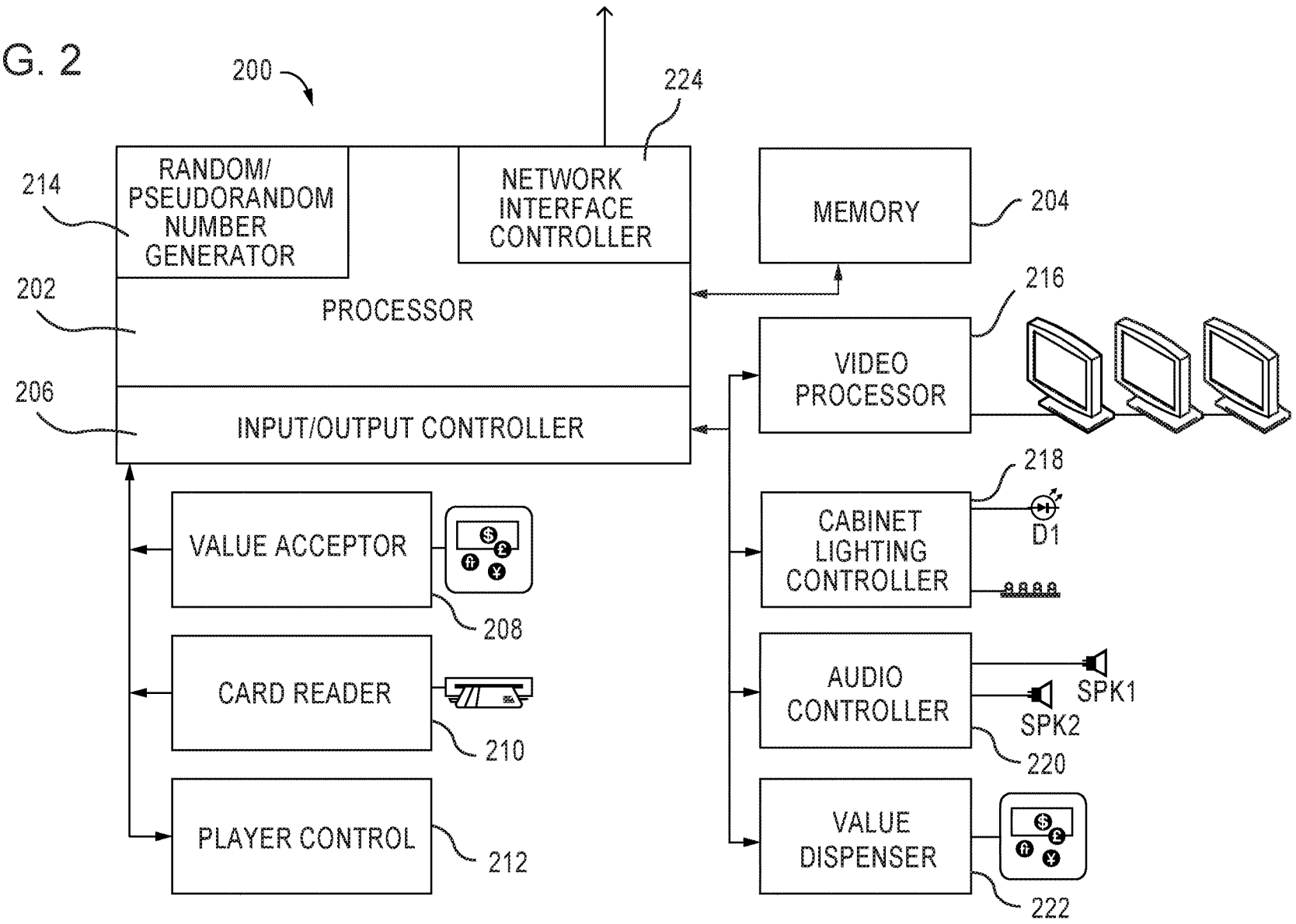
FIG. 2 is a functional block diagram of the gaming device technology components of a gaming system.

Turning now to FIG. 2, the features and advantages of the gaming system described above will now be described in terms of the various technology components for allowing player interaction with the gaming device 100.

FIG. 2 illustrates a functional block diagram of an embodiment of technology components of gaming device 100 that are specially configured to carry out the game function and operations described herein. The functional elements shown in FIG. 2 cooperate, on a broad and general level, to function as gaming device 100. The subject matter and functional operations described in relation to FIG. 2 can be embodied in hardware, software, or a combination thereof. Described hardware includes the structures described and their functional or operational equivalents. Described functions may be performed by hardware, digital circuitry, computer software, computer firmware, or functionally equivalent combinations thereof.

In one embodiment, gaming device 100 is functionally controlled by control unit 200. Control unit 200 is specifically configured and functions to perform all aspects of operations for providing the game. Control unit 200 includes at least one specially configured processor and at least one controller configured to operate with at least one memory device and at least one data storage device, at least one input device, and at least one output device. In one embodiment, control unit is also configured to communicate with a server device through a network.

In one embodiment, control unit 200 includes at least one specially configured processor 202 or central processing unit (CPU). In one embodiment, specially configured processor 202 include arithmetic logic units and math co-processors also known as floating point units. In one embodiment, specially configured processor 202 includes registers for holding instructions or other data, and cache memory for storing data for faster operation thereupon. In one embodiment, specially configured processor 202 may be a multi-core processor that includes two or more processors for enhanced performance, more efficient parallel processing, or other advantageous computing functions. In another embodiment, specially configured processor 202 may be one or more processing devices such as microprocessor(s) or integrated circuit(s) and may include one or more controllers. It should be appreciated that in some embodiments, a general purpose processor could be programmed to perform the functions of specially configured processor 202.

A controller, in one embodiment, is a device or a software program that manages or directs the flow of data between two entities. Often, controllers are special purpose circuitry or software that solve a technical communications problem between different technology systems. In one embodiment, a controller functions as an interface between two systems while managing the communications between the systems. In another embodiment, a controller functions as an interface between a processor and a peripheral device and functions to control the peripheral device.

At least one specially configured processor 202 or controller of control unit 200 is specially configured to communicate with at least one memory device, generally shown as memory device 204 in FIG. 2. In one embodiment, memory device 204 includes one or more memory structures for storing instructions and various types of game data. Memory structures include one or more random access memory units (RAMs) units, one or more read only memory units (ROMs), one or more flash memory units including solid state drives (SSDs), one or more electrically erasable/programmable read only memory units (EEPROMs).

It should be appreciated that in one embodiment, communication with a memory device by a processor or a controller encompasses the processor or controller accessing the memory device, exchanging data with the memory device, or storing data to the memory device.

Memory device 204 may store all program code and game code (collectively the "code"), and operation data necessary for the operation of the gaming device 100 and execution of the gaming features described hereinbelow. In an alternative embodiment, game code and operation data necessary for the operation of the gaming device 100 may be store in a distributed manner such that some code is stored in memory device 204 and other code is stored remotely from gaming device 100. In one embodiment, the code and operation data necessary for the operation of the gaming device includes, for example, basic input and output function data, instruction fetching data, bus and network communication protocol data, and like data necessary for an operational gaming device 100. In one embodiment, the code and operation data necessary for the execution of the gaming features includes, for example, game image data, game rule data, pay table data, game mode and timing data, gaming value and wager parameter data, and random or pseudo-random number generation data.

In addition to the memory device 204 described above, in one embodiment, the code and operation data for the operation of the gaming device described above may be stored in removable game cartridges or flash drives, a compact disk ROM, a digital versatile disk (DVD) optical storage technology, or suitable other fixed non-transitory storage mediums. In another embodiment, part or all of the code and operational data for operation of the gaming device or for execution of the game features may be stored in a remote memory structure and be downloaded to the memory device 204 via a network connection.

For a player to interact with gaming device 100, control unit 200 receives and processes player inputs, and control unit 200 causes processed results to be output or communicated to the player. In one embodiment, player inputs are recognized and processed or directed for processing by input/output (I/O) controller 206. Further, I/O controller 206 may process and direct player outputs for communication to the player. I/O controller 206 can function as the intermediary between the specially configured processor 202 and one or more input devices to control information and data flow therebetween. I/O controller 206 may also function as the intermediary between the specially configured processor 202 and one or more output devices to control information and data flow therebetween. I/O controller 206 is configured to understand the communication and operational details (such as hardware addresses) for each attached input device and output device. In this manner, specially configured processor 202 is freed from the operational details of the peripheral I/O devices. For example, in one embodiment where an input or output device is changed or upgraded, I/O controller 206 can be changed without changing other gaming system 100 components.

In one embodiment, a player deposits value into gaming device 100 by inserting some form of currency into a value acceptor 208 for game play. Alternatively, a player deposits value into gaming device 100 by inserting an encoded paper ticket into a value acceptor 208 for game play in one embodiment. Value acceptor 208 can be combined with a currency reader and validator, and a code reader for reading value encoded on paper tickets. Value acceptor 208 may read, validate and communicate the amount of the inserted value to the specially configured processor 202. Specially configured processor 202 can establish a gaming credit balance for the player based on the communication from the value acceptor 208. Specially configured processor 202 can also communicate the player's credit balance on a credit balance display of gaming device 100. During game play, each time a player risks a wager on an outcome, specially configured processor 202 processes the wage and determines the amount of credits to debit from the player's credit balance. When a winning outcome is generated, specially configured processor 202 is configured to determine the amount of credits to add to the player's credit balance.

As previously mentioned with respect to FIG. 1, a variety of value acceptance arrangements are possible. In one embodiment, the value acceptor 208 could include magnetic strip or chip card readers to accept and transfer value. Value acceptor 208 may also be configured to accept and transfer non-traditional currencies such as digital currencies. In these embodiments, I/O controller 206, a specially configured processor 202, or both contain appropriate control instructions to communicate and extract value from the inserted item containing value. In one embodiment, use of a magnetic strip or embedded chip card, for example a bank card, for value insertion requires specially configured processor 202 to communicate, via network interface controller 224 (described below), with devices external to the gaming device 100.

In one embodiment, card reader 210 may be included in gaming device 100 to accept player loyalty cards. For example, card reader 210 can extract account identifying information from the card and utilizes this information to access the associated account information stored remotely via network interface controller 224. In embodiments where player loyalty/player tracking systems are employed, a player's loyalty account and record of gaming activity can be stored in a networked storage location or database. Specially configured processor 202 is configured to record the player's gaming activity in memory device 204 during the duration of loyalty card insertion. When the loyalty card is removed from card reader 210, recorded gaming activity is uploaded, via network interface controller 224, to the remote storage location associated with the player's account. In this manner, the player's gaming activity can be further processed and analyzed, and the player can be awarded loyalty rewards based upon his activity data.

In various embodiments, player control 212 receives a player's game inputs and communicates the player's game inputs to specially configured processor 202. The player's game inputs may include, but are not limited to, wager amounts, pay line selections, game control signals, and cash-out signals. The player control 212 may generate signals based on button presses, touch screen activations, or voice control. The player initiated signals are propagated to the specially configured processor 202 by I/O controller 206. Further, the player initiated signals may direct and inform execution of the game instructions stored in memory device 204 and configured to be executed by specially configured processor 202.

In one embodiment, specially configured processor 202 is configured to execute stored program code and instructions which generate random numbers or pseudo-random numbers. In one embodiment, as illustrated in FIG. 2, a random number generator (RNG) 214 is a software module configured to be executed by specially configured processor 202 for the generation of a true random or pseudo-random number. The code for RNG 214 may be stored in memory device 204. RNG 214 generates random numbers for use by the gaming software during game execution. In one embodiment, random numbers are utilized by game software for the random selection of one or more game symbols from a set of game symbols during a game. As a non-limiting example, the set of game symbols can include numbers, letters, geometric figures, symbols, images, character, animations, blank symbols (e.g., the absence of symbols), or any other suitable graphical depiction. In various embodiments, once random symbols are selected based upon the random number generated by RNG 214, patterns of symbols are compared to determine wagering outcomes. In an alternative embodiment, gaming device 100 may include a hardware based random number generator that is in communication with specially configured processor 202 to supply random numbers for game generation purposes. The hardware based random number generator may be incorporated into specially configured processor 202 or can be separate from specially configured processor 202.

In yet another embodiment, the random generation of "numbers" or symbols may be performed with electromechanical components. For example, gaming devices such as gaming device 100 may incorporate a plurality of mechanical reels rotatable about a common axis. A plurality of indicia or symbols may be positioned around the periphery of the plurality of reels. Each of the indicia or symbols on each reel may indicate separate detectable reel stop positions. The gaming device 100 can set the reels into a spinning/rotation motion based on a signal triggered by pulling a lever or pushing a button on the gaming device 100. In some embodiments, the gaming device 100 can stop the reels by the gaming device 100 actuating, on a random timing basis, a suitable mechanical or electro-mechanical reel brake. When the reels stop rotating, one or more displayed stop positions of each reel are detected. Since the stop positions are each associated with an indicia or symbol, the gaming device can determine whether the combination of displayed stop positions (i.e., translating to a combination of displayed symbols) results in one or more winning symbol combinations.

Returning to FIG. 2, control unit 200 controls the function and output of a plurality of output devices utilized by gaming device 100. In various embodiments, I/O controller 206 serves as an interface unit between specially configured processor 202 and output devices such as video processor 216, cabinet lighting controller 218, audio controller 220, and value dispenser 222.

In one embodiment, video processor 216 communicates with specially configured processor 202 to render all game graphics, video displays, and information on gaming device 100's one or more video display units. In one embodiment, video processor 216 includes one or more processors, controllers, and/or graphics cards for processing the game images, outcomes, and animated displays and coordinating the processed data to be display between, among, or across any or all display devices. In various embodiments, this may include being configured to simulate objects and the movement of objects which represent video reels containing sets of gaming symbols.

It should be appreciated that in certain other embodiments where physical mechanical reels are utilized by the gaming device 100 as a game displays, reel controllers and stepper motors would be provided in lieu of or in addition to video processor 216.

In embodiments which utilize cabinet lighting as described with respect to FIG. 1, a cabinet lighting controller 218 may be utilized to coordinate and control the color and timing of cabinet lighting displays with specially configured processor 202. In certain embodiments which utilize sound design, specially configured processor 202 may utilize audio controller 220 to coordinate and control the sound emissions. In one embodiment, audio controller 220 may include one or more audio processing cards for generating sound and for driving the one, two or more speakers that may be included with gaming device 100.

In various embodiments, players may collect remaining credit value by initiating a signal via player control 212 which is communicated to specially configured processor 202 via I/O controller 206. The signal triggers a readout of the player's credit amount and specially configured processor 202 initiates a value dispensing signal which, in turn, is communicated to value dispenser 222. In one embodiment, value dispenser 222 can be controlled to issue the player's credit value using any of the types of value discussed herein. In some embodiments, the player's credit value may be issued to the player via a printed and dispensed encoded paper ticket or token which the player can then exchange at a special purpose kiosk or cashier location for the monetary value encoded into the ticket or token. In some embodiments, the specially configured processor 202 can direct the value dispenser 222 to issue to the player an appropriate amount of coin or bills directly to the player. Additionally, or alternatively, in some embodiments, the player may have the option to electronically direct the credit value to an account associated with the player.

In some embodiments, control unit 200 of gaming device 100 may communicate with one or more devices outside the gaming device 100. For example, gaming device 100 may be connected to a larger gaming network via a local area network (LAN) or a wide area network (WAN). Control unit 200 may communicate with one or more central servers, controllers, or remote devices to execute games, establish credit balances, participate in jackpots, etc. In such embodiments, network communications and connections are accomplished via a network interface controller 224. Network interface controller 224 can be a digital circuit board or card installed in control unit 200 to provide network communications with external devices.

In some embodiments, various additional features and functions are performed by control unit 200. For example, control unit 200 may be specially configured with appropriate software to track all game play events that occur on gaming device 100. In some embodiments, control unit 200 may audit all recorded monetary transactions, including all wager amounts, game outcomes, game winnings, and game payouts that occur through gaming device 100. Further, some embodiments may include security software to assist in protecting the gaming device 100 from tamper or alteration attempts.

Games Including Variable Symbol Sets for Variable Win Frequency

In FIGS. 3A, 3B, 4-7 and 8A-8C, a gaming system and method are disclosed as having variable symbol sets for variable win frequency gaming. The gaming system includes a plurality of symbol sets. In some embodiments, the plurality of symbol sets may be represented as a plurality of reel strip sets. For ease of visualizing the plurality of symbol sets, the figures will be described in the context of the plurality of reel strip sets. Each reel strip set may include a plurality of reel strips, where each reel strip includes a plurality of symbols associated with a reel of the gaming system. Each reel strip set may have a different hit rate frequency. Further, each reel strip set may have identical or nearly identical return to player (RTP) values.

In one embodiment, the gaming system may randomly select a first reel strip set for generating game outcomes. After the gaming system generates a winning outcome, the gaming system may select a second reel strip set from the plurality of reel strip sets. In some embodiments, the second reel strip set may have a higher hit rate frequency than the first reel strip set. The second reel strip set increases the chance that the subsequently played game(s) will also result in winning outcomes for the player. Play may continue until a non-winning outcome is generated. The gaming system may select the first reel strip set upon the occurrence of a non-winning outcome. In some embodiments, the first reel strip set may have a lower hit rate frequency than the second reel strip. In this manner, the gaming system may select and utilize a different reel strip set from a plurality of reel strip sets to vary the player experience with the gaming system. It should be appreciated that the use of the relative terms "higher" and "lower" with "hit rate frequency" value throughout this disclosure means "greater than" and "less than," when compared relative to each other. It should be appreciated that a winning outcome, in one embodiment, may include outcomes resulting in any amount of award or value being returned to the player. In one embodiment, a winning outcome may include outcomes resulting in a predetermined amount or greater of award or value being returned to the player.

Figure 3A:
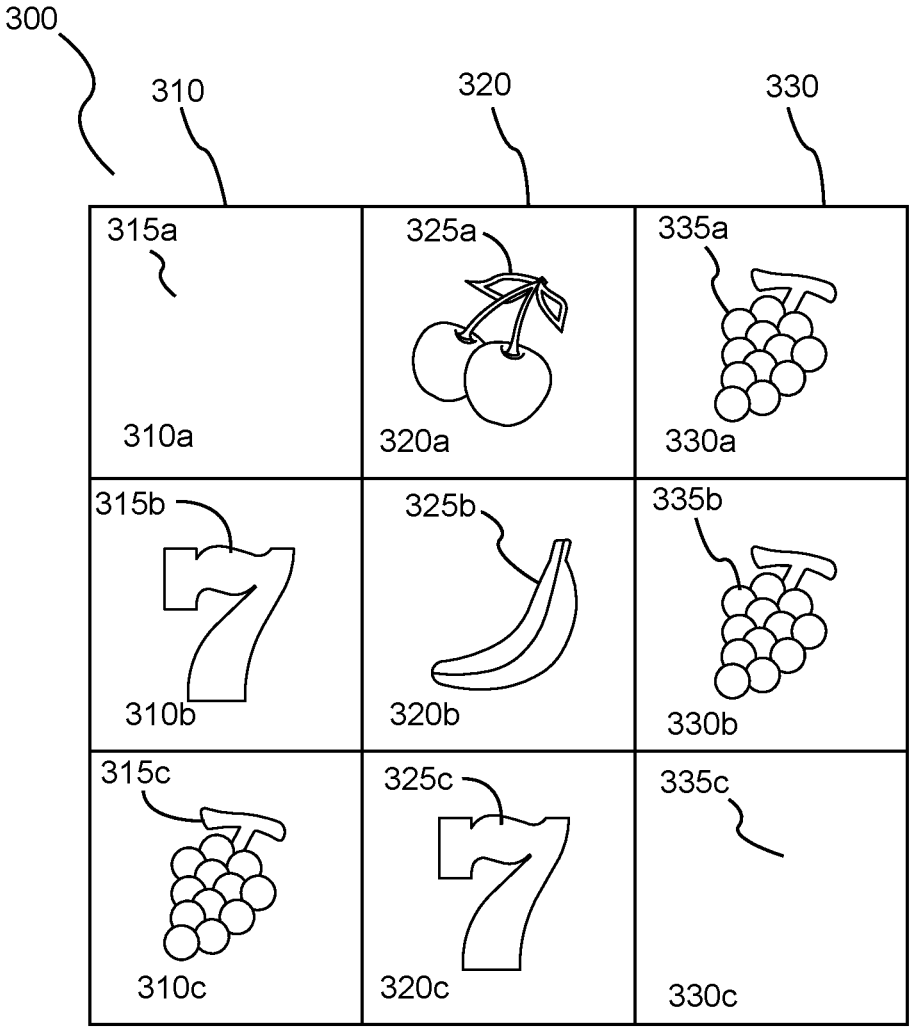
FIGS. 3A and 3B illustrate screen shots of one embodiment of a gaming system having varying symbol sets for variable win frequency gaming.
Figure 3B:
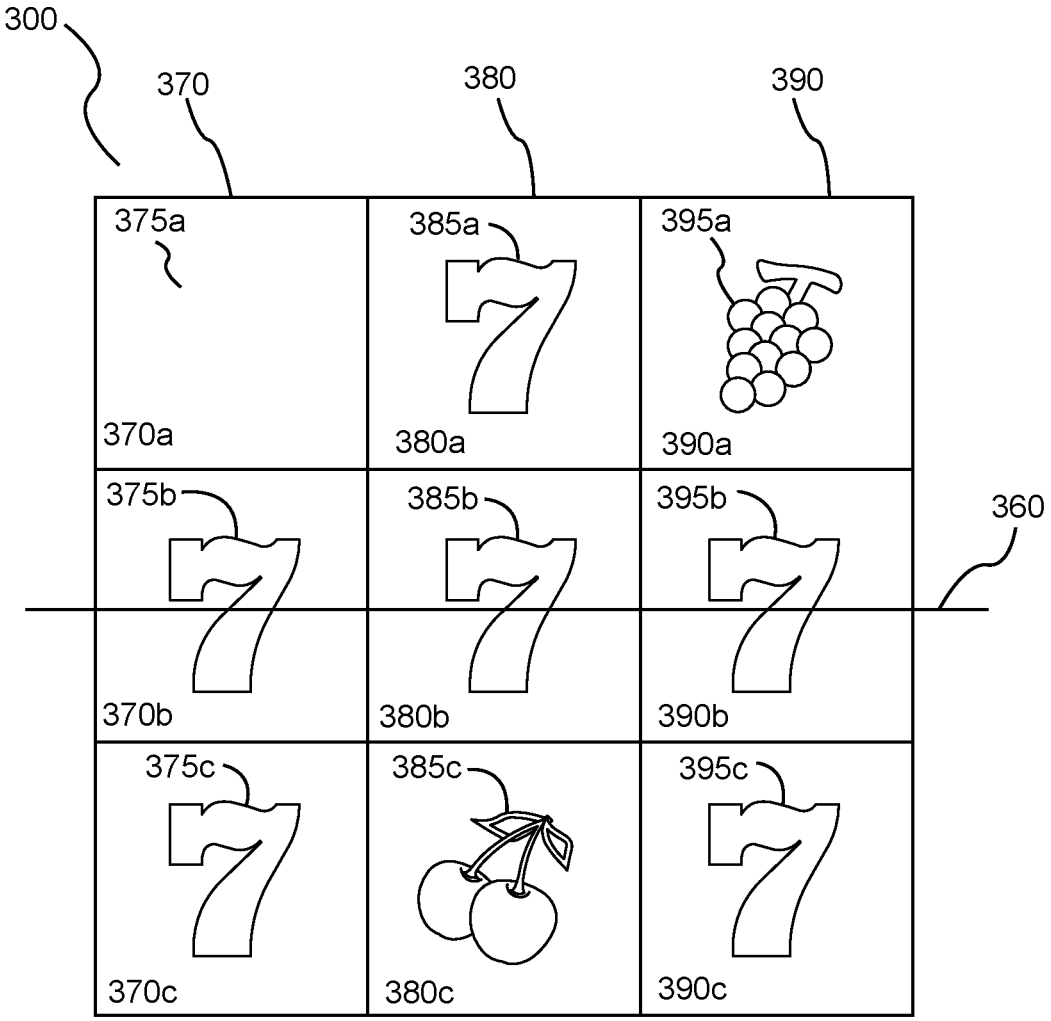

FIGS. 3A and 3B illustrate screen shots of one embodiment of a video display of a gaming system and method having variable symbol sets for variable win frequency gaming.

FIG. 3A illustrates one embodiment of a game display 300 that the gaming device 100 may display on a display device. In one embodiment, game display 300 may be displayed on first display 122 of gaming device 100 illustrated in FIG. 1. However, any other suitable display may be used. The game display 300 displays a set of a plurality of reels 310, 320, and 330 as illustrated in FIG. 3A. It should be appreciated that "reel" as used herein may, in some embodiments, refer to a video display area (e.g., a virtual reel) for displaying one or more symbols randomly generated from a reel strip set. As also illustrated in FIG. 3A, the reels 310, 320, and 330 are displayed substantially side by side. It should be appreciated that reels 310, 320, and 330 can be displayed with any suitable amount of separation or no separation. It should be appreciated that the game shown in game display 300 is merely representative and may have more or fewer game elements shown in the game display 300. For example, in some embodiments, game display 300 may have additional or fewer game reel display areas.

Each of reels 310, 320, and 330 are associated with one of a plurality of sets of symbols, where each of the plurality of sets of symbols includes a plurality of symbols. Each set of symbols of the plurality of sets of symbols associated with each reel is referred to herein as a "reel strip." It should be appreciated that the language "reel strip(s)" is used merely for illustration purposes throughout this disclosure. In some embodiments, predetermined reels strips may be used. In other embodiments, a reel strip is a representation of a set of symbols, where each of the symbols in the set of symbols is associated with a probability of being generated for display in the visible symbol display areas of the virtual reel. In some such embodiments, an actual or physical reel strip is not used in the game. Each of these different sets of symbols associated with a reel, (i.e., each reel strip) may include the same symbols associated with the same or different probabilities of being generated. In other embodiments, these different reel strips may include different symbols.

Each reel 310, 320, and 330 may be associated with the same or a different reel strip (i.e., the same plurality of symbols from the first set of symbols, or a different plurality of symbols from the first set of symbols). The set of symbols may be predefined and may include numbers, letters, geometric figures, symbols, images, character, blank symbols (e.g., the absence of symbols), animations, or any other suitable graphical depiction. The symbols in the set of symbols may have game functions associated therewith. The associated game functions may include pay symbols and special or designated symbols. In one embodiment, the special or designated symbols may include scatter symbols or wild symbols.

In one embodiment, a set of reel strips containing the reel strip for each reel of a gaming system is predefined. For example, in a three reel game, a reel strip set may contain at least three reel strips which may be associated with the reels and utilized in the play of a game. In a like manner, in an embodiment of a five reel game, a reel strip set may contain at least five reel strips which may be associated with the reels and utilized in a play of a game.

The probability of any combination of symbols being randomly generated and displayed on a gaming display is a mathematical function of the number of symbols contained on a reel strip, and the number of reels in a game. For example, consider a three reel gaming system having 20 symbols associated with each reel strip of the reel strip set for the three reels of the gaming system. The probability that any one particular combination of symbols will be randomly generated across the three reels is 1/(20×20×20) or a 1 in 8,000 chance. Stated differently, if a three reel gaming system utilizes three 20 symbol reel strips in a reel strip set, there are 8,000 equally possible outcomes for each play of a game. In contrast, consider a five reel gaming system having 20 symbols associated with each reel strip of the five reels of the gaming system. The probability that any one particular combination of symbols will be randomly generated across the five reels is 1/(20×20×20×20×20) or a 1 in 3,200,000 chance. Thus, if a five reel gaming system utilizes five 20 symbol reel strips in a reel strip set, there are 3,200,000 equally possible outcomes for each play of a game. As can be appreciated, in some embodiments more or less than twenty symbols may be associated with a reel strip, and the number of symbols associated with a reel strip may be different from the number of symbols associated with another reel strip contained in a reel strip set.

In one embodiment, because a reel strip set may be predefined, a reel strip set may have a known hit rate frequency value and a known RTP value. The hit rate frequency value and the RTP value are statistical characteristics of the reel strip set and the defined pay table of a game, where the pay table of the game associates an award value with certain game symbol combination outcomes. The hit rate frequency and the RTP values may be calculated and may be utilized to describe or characterize a game.

The percentage "hit rate" or the "hit rate frequency," as utilized herein, refers generally to the theoretical percentage of expected winning games over a long period of time on a gaming system played with a particular reel strip set. The hit rate frequency may be calculated as the total number of possible winning outcomes divided by the total number of possible symbol combinations. Returning to the example three reel gaming system having 20 symbols associated with each reel strip of the reel strip set for the three reels of the game, there are 8000 possible outcomes for each play of this gaming system. In one embodiment, if 800 of these outcomes are set (e.g. by the pay table of the game) to produce a winning outcome to a player, a player will likely generate a winning outcome on 10% of the plays. The reel strip set, in this embodiment, has a hit rate frequency of 10%. In another embodiment of the same gaming system, if 4000 of the possible 8000 outcomes are set to produce a winning outcome to a player, a player will likely generate a winning outcome on 50% of the plays. The reel strip set in this embodiment has a hit rate frequency of 50%. As can be appreciated from this example, the hit rate frequency of a reel strip set is dependent upon the distribution of symbols on the reel strip and the defined winning outcomes (i.e., the pay table) of the game. The rate at which a player achieves winning outcomes on a gaming system may enhance the player's satisfaction with the game.

The percentage "return to player," or RTP (followed by a numeric percentage, i.e. RTP 92.8%), as utilized herein, refers generally to the theoretical payout percentage, or the return (of value) to player, of a gaming system over a long period of time. The RTP percentage describes the expected ratio of money paid out to money wagered of a gaming system. The RTP percentage can also be viewed as defining the hold of the gaming system, i.e. the amount of money retained by the gaming system (i.e., the casino or "house"). For example, an RTP value of 92.8% means that over many plays of a gaming system utilizing a particular reel strip set, an average of $92.80 will be paid out for every $100 wagered on the gaming system. The remaining $7.20 wagered on the gaming system will be retained by the house. In a like manner, a RTP value of 86% means that over many plays of a gaming system utilizing a particular reel strip set, an average of $86 will be paid out for every $100 wager on the gaming system. The remaining $14 wagered on the gaming system will be retained by the house.

Generally, the RTP for a three reel gaming system using a 20 symbol reel strip set may be calculated by identifying the defined winning outcome combinations for the gaming system and calculating a probability of the occurrence of each one of the defined winning combinations. The probabilities of occurrence of each one of the defined winning outcome combinations are then summed to obtain the theoretical RTP of the reel strip set.

Returning to the example used above, in a three reel gaming system having 20 symbols associated with each reel strip of the reel strip set, there are 8000 possible outcomes for each play of this game. In one embodiment, suppose there is only one defined symbol combination that produces a winning outcome, and the winning outcome combination pays out 7500 multiplied by ("7,500×") the unit wagered, the theoretical RTP for this gaming system is 7500/(20×20×20) or 7500/8000 which equals 0.9375 or 93.75%. In this same example of a three reel gaming system having 20 symbols associated with each reel strip of the reel strip set, if there are 800 symbol combinations that produces a winning outcome, and each winning outcome combination pays out 8× the unit wagered, the theoretical RTP may be calculated as 800× (8/(20×20×20) or 800× (8/8000) which equal 0.8 or 80%. In yet another example using this same three reel gaming system having eight winning outcomes distributed as one winning outcome paying 5000× the unit wagered, two winning outcomes paying 500× the unit wagered and five winning outcomes paying 250× the unit wagered, the theoretical RTP calculation would be: 5000/(20×20×20)+2×(500/(20×20×20))+5×(250/(20×20×20)) which equals 0.625+(3×0.0625)+(5×0.03125). In this case, the theoretical RTP for this gaming system is 0.90625, or 90.625%.

A player of each of the above mentioned example games will have a different gaming experience. Thus, a gaming system having the same three reels and the same reel strip set may produce different gaming experiences based upon the definition of winning outcome symbol combinations and their respective associated pay out award values. It should be appreciated that although in the example embodiments the payout award is described as an integer multiple of the unit wagered, in other embodiments, the pay out award may be a fractional multiple of the unit wagered. That is, for each unit of value wagered, there may exist symbol combinations that result in a winning outcome of less that the amount of the unit risked, such as 0.6× the unit wagered. For example, in a gaming system where the unit wagered is $1, there may exist symbol combinations that result in a winning outcome of $0.60. Any fractional or integer multiple of a unit wagered may be used to define an individual combination award amount as long as the overall RTP of the gaming system does not exceed 100%.

As can be appreciated from the examples, both the hit rate frequency and the RTP of a reel strip set is dependent upon the distribution of symbols on the reel strips of a reel strip set and the defined symbol combination that produces a winning outcome of the game. However, in many embodiments, the defined symbol combination that produces a winning outcome (i.e., the pay table) may be fixed in a pay table that may not be changed once determined. Thus, to vary the player experience with the gaming system in embodiments where the pay table may not be adjusted during play, a gaming system may select and utilize a different reel strip set from a plurality of reel strip sets for a play of the game. As will be apparent, by providing a gaming system with varying reel strips, (i.e., by providing a gaming system with varying symbol sets) a variable win frequency gaming system may be created.

Returning to FIG. 3A, the game display 300 depicts a plurality of symbol display areas 310*a*, 320*a*, 330*a*, 310*b*, 320*b*, 330*b*, 310*c* 320*c*, and 330*c*. This plurality of symbol display areas can be associated in a manner that provides the appearance of game reels. It should also be appreciated that the symbol display areas may not be associated with game reels in some embodiments. As illustrated in FIG. 3A, symbol display areas 310*a*, 320*a*, 330*a*, 310*b*, 320*b*, 330*b*, 310*c* 320*c*, and 330*c* are associated in a manner that provides the appearance of a set of three game reels. In one embodiment, the plurality of symbol display areas that provide the appearance of three game reels may be arranged in a manner that visibly shows three symbol positions of each of the three game reels (or three reel strips). For example, the symbol display areas 310*a*-310*c*, 320*a*-320*c*, and 330*a*-330*c* are each associated with positions on reels 310, 320, and 330, respectively. As shown in FIG. 3A, symbol display areas 310*a*, 310*b*, and 310*c* are associated with reel 310; symbol display areas 320*a*, 320*b*, and 320*c* are associated with reel 320; symbol display areas 330*a*, 330*b*, and 330*c* are associated with reel 330. The arrangement illustrated in the embodiment of FIG. 3A thus creates a visible display area of the reels strips 310, 320, and 330 comprising three fully visible symbol positions for each reel (310*a*, 310*b*, 310*c*, 320*a*, 320*b*, 320*c*, and 330*a*, 330*b*, 330*c*). When viewed together, reels 310, 320, and 330 appear like a 3-row by 3-column reel array in display 300. In other embodiments, smaller or larger visible areas of the reels can be displayed. That is, the reels 310, 320, and 330 may show fewer or a larger number of visible symbol display areas. While symbol display areas are illustrated with defined boxes, it should be appreciated that in some embodiments, the defined boxes are not visible to the player.

Each reel 310, 320, and 330 may display a plurality of symbols that the gaming system generates from the set of symbols in their respective symbol display areas as illustrated in FIG. 3A. The symbols may be displayed in a manner to appear as though they are vertically descending from the upper positions 310*a*-330*a* through lower positions 310*c*-330*c*, respectively, such that they may form the appearance of symbols along the outer edge of spinning reels. However, it should be appreciated that the reels may be shown to appear to be spinning in any suitable direction. The reels may also be shown spinning in different directions in some embodiments.

To start a gaming session, a player provides the gaming system with a deposit of value, using one of the suitable mechanisms discussed above with respect to FIG. 1 and FIG. 2. The gaming system receives and validates the player's deposit of value. The gaming system can then issue credits (or gaming credits) to the player based on the received value. The credits enable the player to initiate a play of a game on the gaming system and to also place wagers on a play of the game on the gaming system. The gaming system may provide a visual indication of the player's credit balance to the player (not shown).

To initiate a play of a game, the player activates or presses one or more appropriate buttons on the gaming system to deduct credits necessary to play the game and to identify the player's wager. Along with receiving the player's wager, the gaming system may receive pay line selections or other game functions the player wishes to activate in exchange for the wager. The player may also actuate a game start button or a spin button. The gaming system may deduct the appropriate credits from the player's credit balance after the wager or at any suitable time.

In one embodiment, when a player initiates a play of a game by pressing one or more appropriate buttons on the gaming system, a processor of the gaming system selects a reel strip set (i.e., a reel strip for each reel of the game) from a plurality of reel strip sets. The method of operating the gaming system is more fully explained hereinbelow with respect to FIGS. 6A and 6B. In one embodiment, the plurality of reel strip sets may be predetermined and stored in a memory of the gaming system. Upon receipt of the player's wager and activation of the game start button, the gaming system may show a display of spinning reels for each of the reels 310, 320, and 330. The spinning may appear to occur in a vertical top to bottom direction (not shown) or in a vertical bottom to top direction (not shown), or in a combination of vertical directions (not shown).

In one embodiment, the gaming system randomly generates and displays symbols 315*a*, 325*a*, 335*a*, 315*b*, 325*b*, 335*b*, 315*c*, 325*c*, and 335*c*. The displayed symbols include a blank symbol in position 315*a*, a cherry symbol in position 325*a*, a grape symbol in position 335*a*, a 7 symbol in position 315*b*, a banana symbol in position 325*b*, a grape symbol in position 335*b*, a grape symbol in position 315*c*, a 7 symbol in position 325*c*, and a blank symbol in position 335*c*. In one embodiment, the cherry symbol, grape symbol and banana symbol are all "fruit" symbols and have been defined as not creating a winning outcome when a combination of fruit symbols appear as on a pay line that a player has placed a wager upon. A blank symbol has been defined as not creating a winning outcome when a combination including a blank symbol appears on a pay line that a player has placed a wager upon. The 7 symbol has been defined as creating a winning outcome when a combination of the 7 symbols appears as a winning outcome on a pay line that a player has placed a wager upon. It should be appreciated that various definitions of symbol combinations that create winning outcomes are possible and the embodiments discussed herein are merely representative for ease of illustration. For example, in one embodiment, a combination of the 7 symbol may be defined as creating a winning outcome of a high value while various combinations of the fruit symbols may be defined as creating a plurality winning outcomes of comparatively low values. In other embodiments, fruit symbols may be associated with high values. The principles underlying the invention remain equally applicable regardless of the defined outcome values.

For each play of a game, the symbols are randomly generated (selected) by a processor of the gaming system from the associated reel strip set for reels 310, 320, and 330, respectively. The randomly selected symbols are then displayed. As noted above, the gaming system may rely on random generation performed by a pseudo RNG, a true RNG, or hardware RNG in making the random symbol selection.

Figure 4:
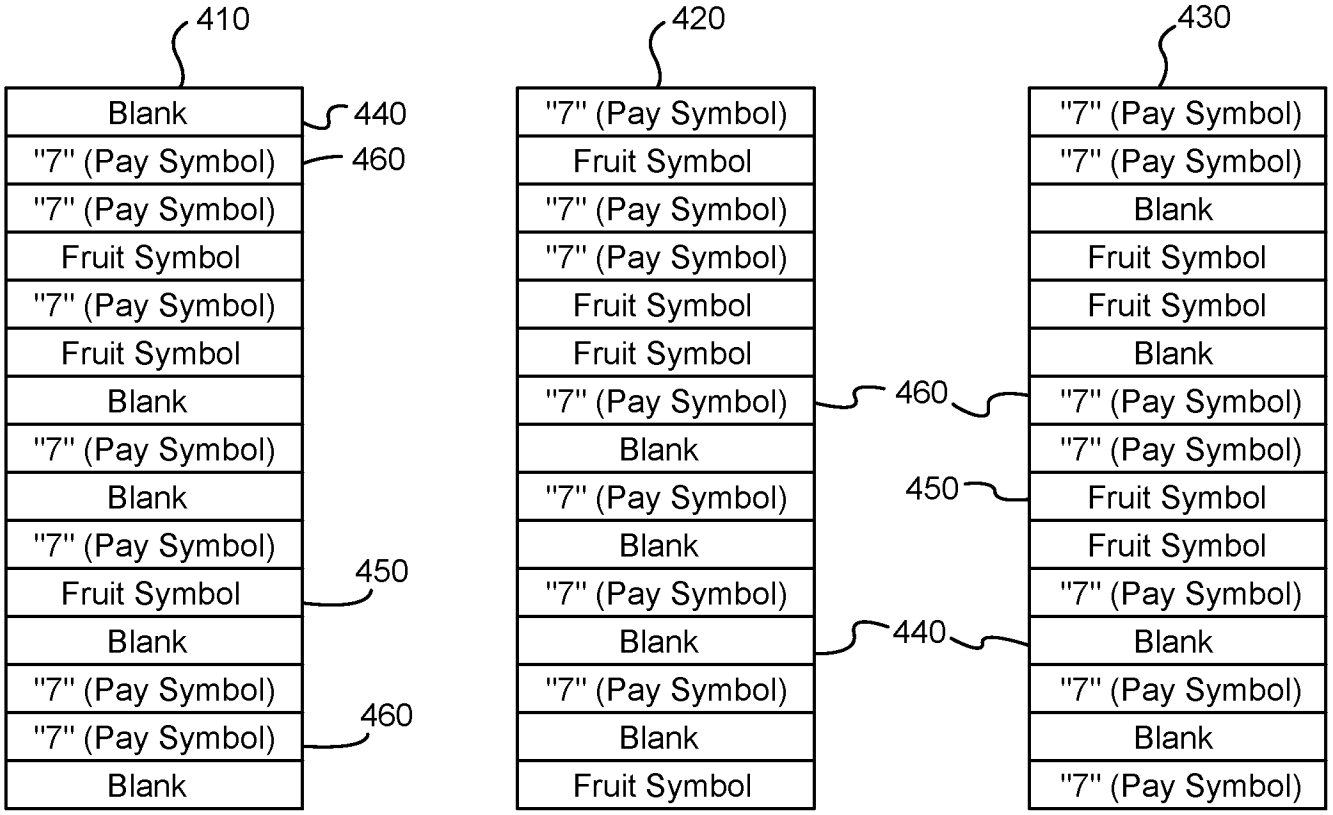
FIG. 4 illustrates one embodiment of a set of reel strips having a low hit rate frequency.

As a starting point for understanding the varying reel strips of the disclosure, a virtual reel strip symbol set utilized to randomly generate and display the symbols on display 300 of FIG. 3A is depicted in FIG. 4. FIG. 4 is an illustration of one embodiment of a reel strip set having a first hit rate frequency, wherein the first hit rate frequency has a lower hit rate frequency than a reel strip set depicted in FIG. 5. For purposes of illustration, reel strip 410 of FIG. 4 is associated with reel 310 of FIG. 3A, reel strip 420 of FIG. 4 is associated with reel 320 of FIG. 3A, and reel strip 430 of FIG. 4 is associated with reel 330 of FIG. 3A. Each reel strip includes blank symbols 440, fruit symbols 450, and pay symbols 460. The hit rate frequency of the reel strip set illustrated in FIG. 4 may be calculated as the total number of possible winning outcomes divided by the total number of possible symbol combinations. Each reel strip in FIG. 4 has 7 symbols (e.g., the "7" pay symbols) that may result in a winning outcome and 8 symbols that will not result in a winning outcome, resulting in 15 total symbols. Thus, the total number of possible winning outcomes is 7×7×7, or 343, and the total number of possible symbol combinations is 15×15×15, or 3375. The hit rate frequency in the example is 343/3375 or 0.1016 or 10.16%. This means that, on average, for every 100 games played on a gaming system utilizing this reel strip set, only an average of 10 will result in winning outcomes being generated.

Figure 5:
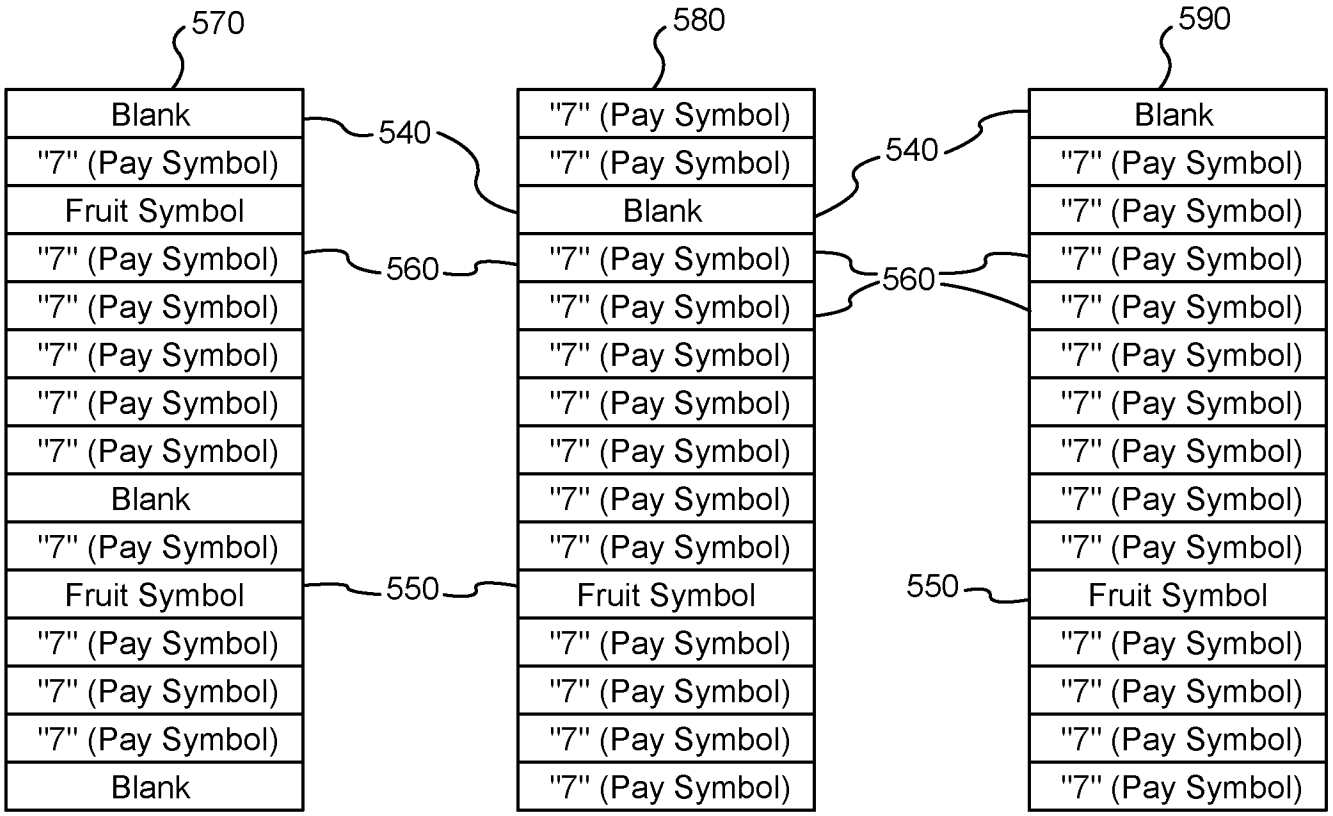
FIG. 5 illustrates one embodiment of a set of reel strips having a high hit rate frequency.

As can be appreciated, when the gaming system is selecting reel strip sets from a plurality of reel strip sets having a low hit rate frequency, a series of non-winning outcomes is likely to occur. This aspect is described more fully hereinbelow with respect to FIG. 7 and FIG. 8A. However, because the symbols are randomly selected, winning outcomes will still occur. When a winning outcome occurs, in one embodiment, the gaming system may vary the utilized symbol set and select a reel strip set from a plurality of reel strip sets having a high hit rate frequency for a play of a game, as illustrated in FIGS. 3B and 5.

FIG. 3B illustrates a screen shot of a next game played on the gaming system after a winning outcome is generated as described herein. In one embodiment, after a winning outcome is generated on the gaming system, the system may select a reel strip set from a plurality of reel strip sets having a high hit rate frequency. In one such embodiment, the gaming system varies the reel strip symbol set by selecting a new reel strip set having symbols associated therewith that provide a higher hit rate frequency value than a reel strip set utilized by the gaming system after a non-winning outcome is generated. In this manner, the probability of the next game resulting in a winning outcome is enhanced.

In FIG. 3B, the game display 300 depicts a plurality of symbol display areas 370*a*, 380*a*, 390*a*, 370*b*, 380*b*, 390*b*, 370*c*, 380*c* and 390*c*. The symbol display areas can be associated in a manner that provides the appearance of game reels, as described above with reference to FIG. 3A. It should also be appreciated that the symbol display areas may not be associated with game reels in some embodiments. As illustrated in FIG. 3B, symbol display areas 370*a*, 380*a*, 390*a*, 370*b*, 380*b*, 390*b*, 370*c*, 380*c*, and 390*c* are associated in a manner that provides the appearance of a set of three game reels 370, 380, and 390. In one embodiment, the plurality of symbol display areas that provide the appearance of three game reels may be arranged in a manner that visibly shows three symbol positions of each of the three game reels. For example, the symbol display areas 370*a*-370*c*, 380*a*-380*c*, and 390*a*-390*c* are each associated with positions on reels 370, 380, and 390, respectively. As shown in FIG. 3B, symbol display areas 370*a*, 370*b*, and 370*c* are associated with reel 370; symbol display areas 380*a*, 380*b*, and 380*c* are associated with reel 380; and symbol display areas 390*a*, 390*b*, and 390*c* are associated with reel 390. The arrangement illustrated in the embodiment of FIG. 3B thus creates a visible display area of the reels 370, 380, and 390 comprising three fully visible symbol positions for each reel. When viewed together, reels 370, 380, and 390 appear like a 3-row by 3-column reel array in display 300. In other embodiments, smaller or larger visible areas of the reels can be displayed. That is, the reels 370, 380, and 390 may show fewer or a larger number of visible symbol display areas. While symbol display areas are illustrated with defined boxes, it should be appreciated that in some embodiments, the defined boxes are not visible to the player or there are no defined boxes.

Each reel 370, 380, and 390 may display a plurality of symbols that the gaming system generates from the set of symbols in their respective symbol display areas as illustrated in FIG. 3B. The symbols may be displayed in a manner to appear as though they are vertically descending from the upper positions 370*a*-390*a* through lower positions 370*c*-390*c*, respectively such that they form the appearance of symbols along the outer edge of spinning reels. However, it should be appreciated that the reels may be shown spinning in any suitable direction. The reels may also be shown spinning in different directions in some embodiments.

To initiate a next play of a game on the gaming system after a winning outcome is generated, the player activates or presses one or more appropriate buttons on the gaming system to deduct credits necessary to play the game and to identify the player's wager. Along with receiving the player's wager, the gaming system may receive pay line selections or other game functions the player wishes to activate in exchange for the wager. The player may also actuate a game start button or a spin button. The gaming system may deduct the appropriate credits from the player's credit balance after the wager or at any suitable time.

In one embodiment, when a player initiates a subsequent play of the game (after a winning outcome is generated) by pressing one or more appropriate buttons on the gaming system, a processor of the gaming system selects a reel strip set (i.e., a reel strip for each reel of the game) from a plurality of reel strip sets. The method of operating the gaming system is more fully explained hereinbelow with respect to FIGS. 6A and 6B. In one embodiment, the plurality of reel strip sets may be predetermined and stored in a memory of the gaming system. Upon receipt of the player's wager and activation of the game start button, the gaming system may show a display of spinning reels for each of the reels 370, 380, and 390. The spinning may appear to occur in a vertical top to bottom direction (not shown) or in a vertical bottom to top direction (not shown), or in a combination of vertical directions (not shown).

In one embodiment, the gaming system randomly generates and displays symbols 375*a*, 385*a*, 395*a*, 375*b*, 385*b*, 395*b*, 375*c*, 385*c*, and 395*c*. The displayed symbols include a blank symbol in position 375*a*, a 7 symbol in position 385*a*, a grape symbol in position 395*a*, a 7 symbol in position 375*b*, a 7 symbol in position 385*b*, a 7 symbol in position 395*b*, a 7 symbol in position 375*c*, a cherry (fruit) symbol in position 385*c*, and a 7 symbol in position 395*c*. In one embodiment, the cherry symbol, grape symbol, and banana symbol (not shown) are all "fruit" symbols and have been defined as not creating a winning outcome when a combination of fruit symbols appears on a pay line that a player has placed a wager upon. A blank symbol has been defined as not creating a winning outcome when a combination including a blank symbol appears on a pay line that a player has placed a wager upon. The 7 symbol has been defined as creating a winning outcome when a combination of the 7 symbols appears as a winning outcome on a pay line that a player has placed a wager upon. It should be appreciated that various definitions of symbol combinations that create winning outcomes are possible and the embodiments discussed herein are merely representative for ease of illustration. For example, as explained above in one embodiment, a combination of the 7 symbol may be defined as creating a winning outcome of a high value while various combinations of the fruit symbols may be defined as creating a plurality winning outcomes of comparatively low values. The principles underlying the invention remain equally applicable regardless of the defined outcome values.

The displayed symbols illustrated in FIG. 3B are randomly selected from a different reel strip set than the displayed symbols illustrated in FIG. 3A. The symbols for reels 370, 380, and 390 in FIG. 3B are selected from reel strip sets having a higher hit rate frequency than the reel strip sets utilized for reels 310, 320, and 330, respectively. As noted above, the gaming system may rely on random generation performed by a pseudo RNG, a true RNG, or hardware RNG when selecting the symbols from the reel strips of the reel strip symbol set.

The reel strip set utilized to randomly generate and display the symbols on display 300 of FIG. 3B is depicted in FIG. 5. FIG. 5 is an illustration of one embodiment of a reel strip set having a second hit rate frequency, wherein the second hit rate frequency is a higher hit rate frequency than a reel strip set depicted in FIG. 4. Reel strip 570 of FIG. 5 is associated with reel 370 of FIG. 3B, reel strip 580 of FIG. 5 is associated with reel 380 of FIG. 3B, and reel strip 590 of FIG. 5 is associated with reel 390 of FIG. 3B. Each reel strip includes blank symbols 540, fruit symbols 550, and pay symbols 560. The hit rate frequency of the reel strip set illustrated in FIG. 5 may be calculated as the total number of possible winning outcomes divided by the total number of possible symbol combinations. Reel strip 570 has 10 symbols which may result in a winning outcome and 5 symbols which may not result in a winning outcome. Reel strip 580 has 13 symbols which may result in a winning outcome and 2 symbols which may not result in a winning outcome. Reel strip 590 has 13 symbols which may result in a winning outcome and 2 symbols which may not result in a winning outcome. Each reel strip in FIG. 5 has 15 total symbols. Thus, the total number of possible winning outcomes is 10×13×13, or 1690, and the total number of possible symbol combinations is 15×15×15, or 3375. The hit rate frequency in the example is 1690/3375 or 0.5007 or 50.07%. This means that, on average, for every 100 games played on a gaming system utilizing this reel strip set, an average of 50 will result in winning outcomes being generated.

As can be appreciated, when the gaming system selects a reel strip set from a plurality of reel strip sets having a high hit rate frequency, it is more likely that the gaming system will generate a winning outcome. When the gaming system sequentially selects back to back reel strip sets having a high hit rate frequency, the gaming system is more likely to generate a series of winning outcomes. A series of winning outcomes may greatly increase the player's excitement. This aspect is described more fully hereinbelow with respect to FIG. 7 and FIG. 8B.

It should be appreciated that the payout amounts associated with winning outcome symbol combinations (i.e., the pay table) may be selected such that a set of reel strips having a low hit rate frequency and a set of reel strips having a high hit rate frequency may have an identical or substantially similar RTP value. In one embodiment, the gaming system and method utilizes reel strip sets (both low and high value reel strip sets) created such that the overall RTP amount for any particular gaming system remains constant, or substantially constant (i.e., within a designated predetermined range of return to player amounts) during a plurality of plays of a game. In this manner, the gaming system's overall RTP value remains certain even though a plurality of reel strip sets having different hit rate frequency values are utilized during play of a series of game.

Figure 6A:
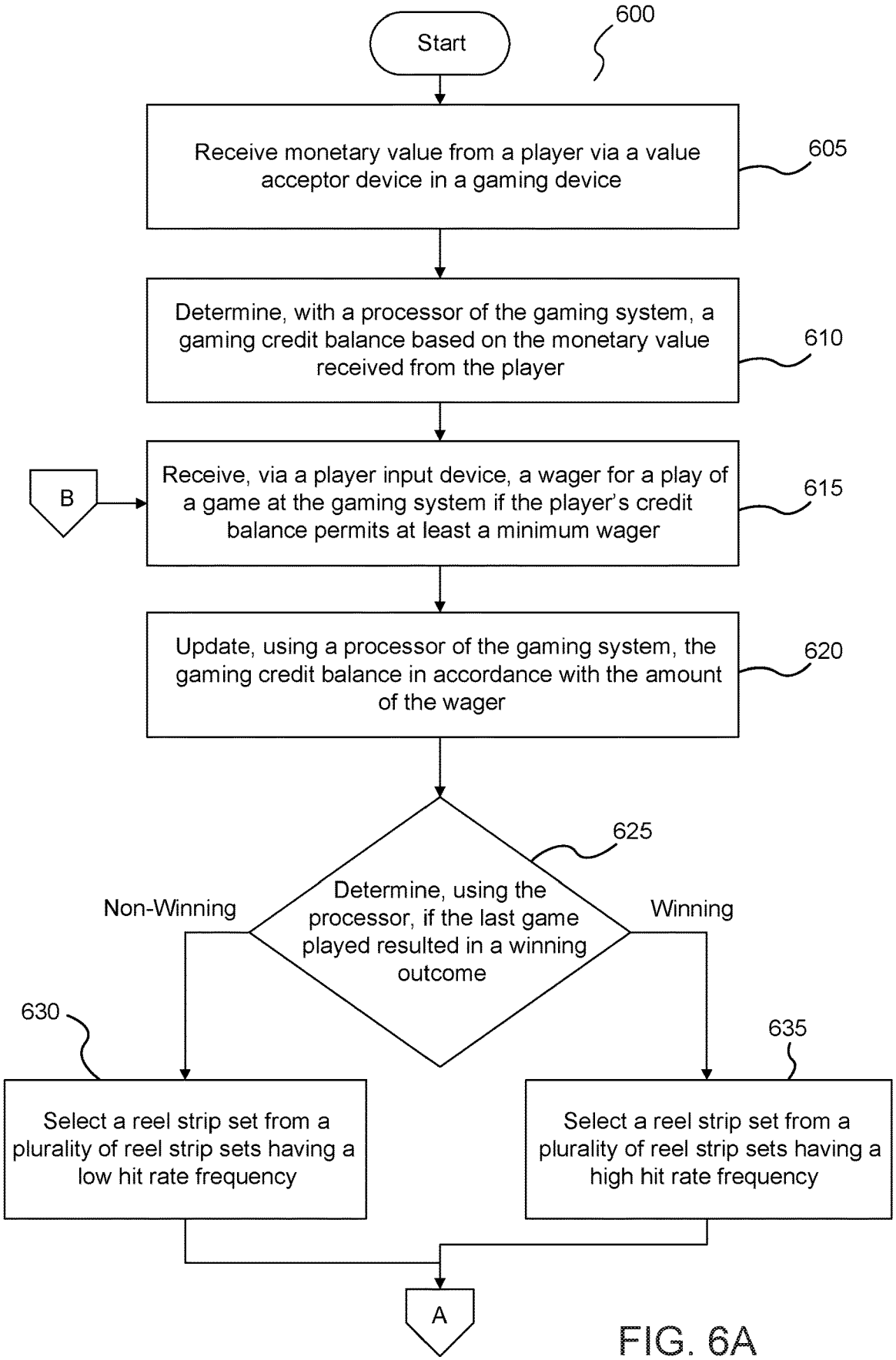
FIGS. 6A and 6B illustrate one embodiment of a method of operating the gaming system to provide variable symbol sets for variable win frequency gaming.
Figure 6B:
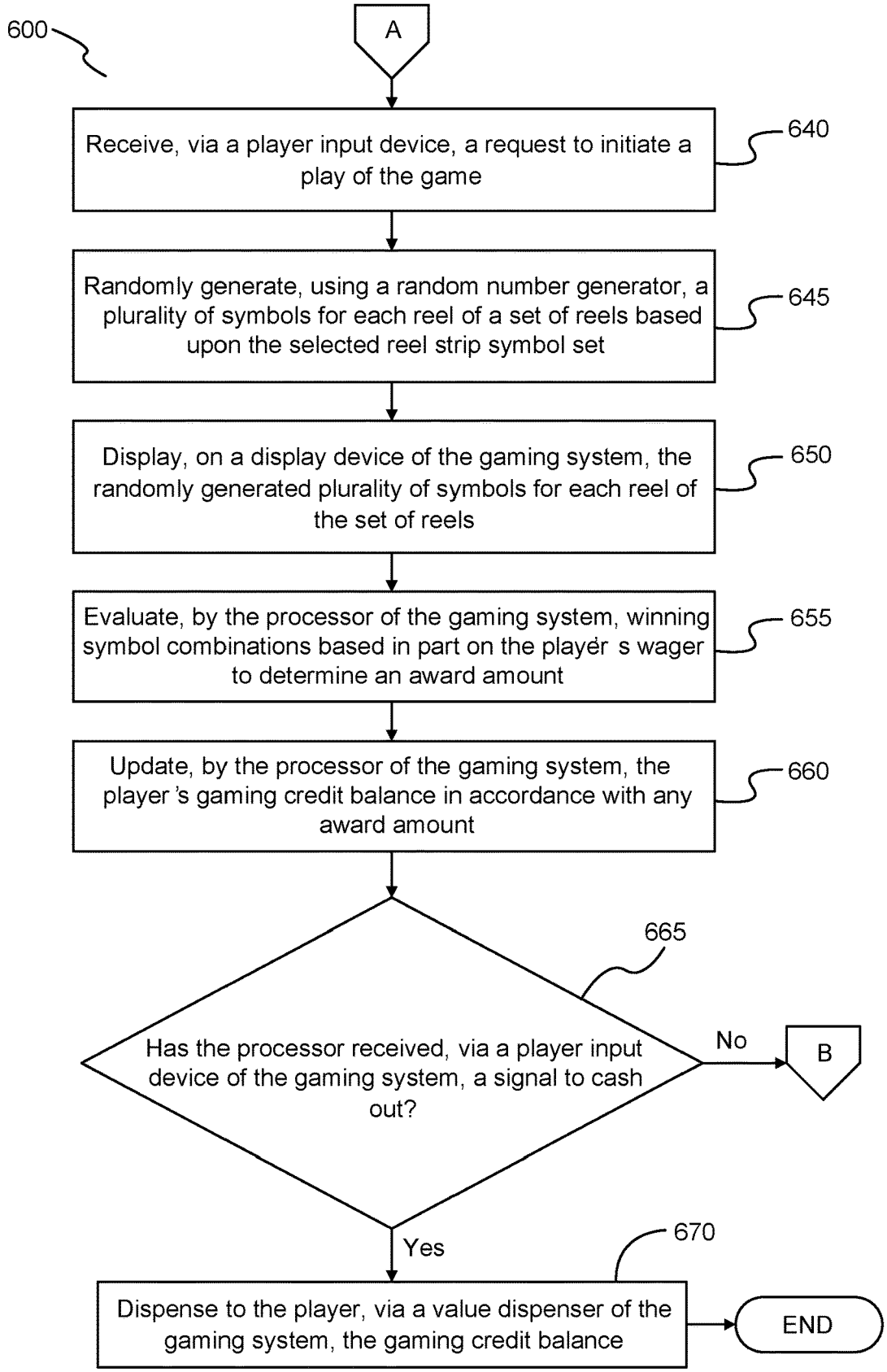

FIGS. 6A and 6B illustrate a flowchart of an example operation 600 of one embodiment of the gaming system and method having variable symbol sets for variable win frequency gaming. In one embodiment, a processor is configured, via instructions stored in a memory device, to perform the operation 600. However, it should be appreciated that other suitable variations of operation 600 are possible. For example, in one embodiment, fewer or one or more additional blocks (not shown) may be employed in operation 600 of the gaming system and method. In other embodiments, the blocks may be performed in any suitable order.

FIG. 6A illustrates one embodiment in which the gaming system receives a monetary value from a player to initiate operation 600. As indicated in block 605, the gaming system may receive monetary value via a value acceptor device associated with the gaming system. The value acceptor device may be, in one embodiment, disposed in a gaming device of the gaming system or in communication with the gaming device as discussed above.

In one embodiment, the gaming system may determine a credit balance based on the monetary value received from the player at a value acceptor device as indicated in block 610. The gaming system may determine, via a processor, a gaming credit balance for the player. The gaming credit balance may be based on the monetary value received from the player at the value acceptor device.

In one embodiment, the gaming system may receive a wager for a play of a game at the gaming device. Block 615 of FIG. 6A illustrates one embodiment where the player's wager may be received via a player input device. The gaming device may allow a player to place a minimum wager, a maximum wager, or any suitable wager amount. Depending on the wager amount, the gaming device may also enable the player to select pay lines across displayed symbol positions on reels in a game. In one embodiment, the gaming system may determine whether the player credit balance is large enough to enable the player's selected wager. The gaming system may prevent the player from placing the wager and starting a play of a game if the player's credit balance is not large enough to support the player's selected wager. If enough credits are not available in the player's credit balance, the gaming system enables the player to insert additional value to obtain the minimum credit level or to cash out of the gaming device.

In one embodiment, the gaming system may use a processor of the gaming device to update a gaming credit balance. The credit balance may be updated in accordance with the player's wager amount as indicated in block 620. Some embodiments, the credit balance is not updated until a later time.

Block 625 illustrates one embodiment in which the gaming system may determine, using a processor, an outcome status of the last game played on the gaming system. For example, the processor may determine whether the last game played on the gaming system resulted in a non-winning outcome or whether the last game played on the gaming system resulted in a winning outcome. In one embodiment, the outcome of the last game played may be utilized to determine the selection, by a processor of the gaming system, of a reel strip set from a plurality of reel strip sets to be used in the current game. In this manner, the outcome of a current game under play may be determined, at least in part, based upon the outcome of the previous game played. It should be appreciated that a winning outcome, in one embodiment, may include outcomes resulting in any amount of award or value being returned to the player. The award or value being returned to the player may include: symbol combination pays, monetary awards, a quantity of free games, a bonus game, a reel or symbol nudge, a quantity of reel re-spins, or any other suitable award or value being returned to the player. In one embodiment, a winning outcome may include outcomes resulting in a predetermined amount or greater of award or value being returned to the player. Thus, in one embodiment, a non-winning outcome may include outcomes resulting in less than a predetermined amount of award or value being returned to a player.

Reel strips are generally discussed above with reference to FIGS. 3A, 3B, 4, and 5. As discussed above, a reel strip set defines the symbols and symbol distribution utilized in a play of a video reel wagering game. For example, in a three-reel gaming system embodiment, each reel strip set of the plurality of reel strip sets includes at least three symbol sets (i.e., one symbol set for each reel) or three reel strips. In a like manner, in a five-reel gaming system embodiment, each reel strip set of the plurality of reel strip sets includes at least five symbol sets (i.e., one symbol set for each reel) or five reel strips. Thus, in one embodiment, a reel strip set contains a reel strip, or set of symbols, for each reel of the wagering game. However, it should be appreciated that in other embodiments, a reel strip set may contain more reel strips than reels of the wagering game. In these embodiments, a reel strip may be randomly selected from the reel strip set for each reel of the wagering game. It should also be appreciated that reel strips are used merely for illustration purposes throughout this disclosure. In some embodiments, predetermined reels strips may be used. In other embodiments, a reel strip is a representation of a set of symbols, where each of the symbols in the set of symbols is associated with a probability of being generated for display in the visible symbol display areas of the virtual reels. In some such embodiments, an actual or physical reel strip is not used in the game.

Reel strips (and reel strip sets) may be described and categorized by mathematical statistics, as generally discussed above with reference to FIGS. 3A, 3B, 4 and 5. Reel strip and reel strip set statistics may include a return to player percentage or RTP. Generally, the RTP percentage represents the theoretical payout percentage, or the return to player, of a gaming system. The RTP percentage describes the expected ratio of money paid out to money wagered of a gaming system. For example, a RTP value of 92.8% means that over many plays of a gaming system utilizing a particular reel strip set, an average of $92.80 will be paid out for every $100 wagered on the gaming system. In a like manner, a RTP value of 86% means that over many plays of a gaming system utilizing a particular reel strip set, an average of $86 will be paid out for every $100 wager on the gaming system. RTP may be considered as a statistical characteristic of a reel strip set.

In one embodiment, each reel strip of each reel strip set of the plurality of reel strip sets may be predetermined or generated in a manner so that each reel strip set provides the same theoretical RTP value. For example, in one embodiment, the theoretical RTP value of each reel strip set contained in the plurality of reel strip sets may be 96%. A reel strip set RTP value of 96% means that over many plays of a gaming system utilizing the reel strip sets contained in the first plurality of reel strip sets, an average of $96 will be paid out for every $100 wagered on the gaming system. In other embodiments, the plurality of reel strip sets may be predetermined or generated in a manner so that the reel strip sets may have minor variances in the RTP value. For example, in one embodiment some of the reel strip sets of the plurality of reel strip sets may have RTP values of 96.1% and other reel strip sets may have RTP values of 96.01%. In yet other embodiments, the plurality of reel strip sets may be predetermined or generated over a narrow range of RTP values. For example, in one embodiment, the plurality of reel strip sets may have statistical RTP values ranging from 95.9% to 96.1%. It should be appreciated that the range of RTP variance across the plurality of reel strip sets may be larger or smaller than the example illustrated.

Reel strip and reel strip set statistics utilized to describe and categorize reel strips may further include a hit rate frequency value, generally discussed above with reference to FIGS. 3A, 3B, 4, and 5. Each reel strip set may have a statistical measurement of the risk associated with a play of a game on a gaming system utilizing the reel strip set. The measurement of the risk associated with a play of a game will be referred to herein as "hit rate frequency." Hit rate frequency is the theoretical percentage of game reel spins that will result in a winning outcome and payout to the player. Stated differently, hit rate frequency indicates, on average over many plays of the gaming system, how many games have a non-winning outcome as compared to how many games have a winning outcome.

In one embodiment, the hit rate frequency of a gaming system is based at least in part upon the number of symbols contained on the reel strips utilized in the gaming system and the definition of a winning outcome as defined by the symbol combinations found in a pay table associated with the gaming system. In one embodiment, gaming systems utilizing reel strip sets having low hit frequencies may generate winning outcomes for a player less frequently. In one embodiment, gaming systems utilizing reel strip sets having high hit frequencies may generate winning outcomes for a player more frequently.

Returning to process flow 600 of FIG. 6A and blocks 630 and 635, in one embodiment, the gaming system operates each play of a game based upon a reel strip set that may be selected from either a first plurality of reel strip sets (block 630) or a second plurality of reel strip sets (block 635). It should be appreciated that the gaming system may also use additional different plurality of reel strip sets in some embodiments. Process flow 600 utilizing the second plurality of reel strip sets in relation to block 635 is described more fully hereinbelow. In process block 630, a first plurality of reel strip sets may contain reel strips having a low hit rate frequency when compared to a second plurality of reel strip sets. In one embodiment, the hit rate frequency of a first plurality of reel strip sets may be 10%. A hit rate frequency of 10% means that over many plays of a gaming system utilizing the reel strips contained in the first plurality of reel strip sets, an average of ten out of every one hundred plays of a game on the gaming system will generate a winning outcome.

Continuing with process flow 600 of FIG. 6A and block 630, in one embodiment, when a processor of the gaming system determines that the last game played resulted in a non-winning outcome, the processor may select a reel strip set from a first plurality of reel strip sets having a low hit rate frequency. In one embodiment, a processor may select a reel strip set from a first plurality of reel strip sets having a hit rate frequency of 10%, or a 1 in 10 chance that the play of the game will result in a winning outcome. In one embodiment, the processor of the gaming system, in block 630, may randomly select a reel strip set from a first plurality of reel strip sets associated with a low hit rate frequency. In one embodiment, the processor of the gaming system, in block 630, may sequentially select a reel strip set from the first plurality of reel strip sets having a low hit rate frequency. In some embodiments, the first plurality of reel strip sets associated with a low hit rate frequency may be predetermined reel strips. In other embodiments, the first plurality of reel strip sets associated with a low hit rate frequency may be randomly generated according to predetermined symbol sets, hit rate frequency constraints, and return to player value constraints. Once the reel strip set has been selected, off page connector A refers to FIG. 6B to continue operation 600.

Turning now to FIG. 6B and off page connector A, block 640 illustrates one embodiment in which the gaming system may receive a request to initiate a play of a game. The request to initiate the play of the game at the gaming system may be received from a player via a player input device in communication with the gaming system. For example, the player may press a spin button on the gaming system to start the spinning reels (or randomly generating symbols using other methods discussed above) for the play of the game.

In one embodiment, the gaming system may use a random number generator to randomly generate a plurality of symbols from a set of symbols based upon the reel strip set selected in block 630, as indicated in block 645. In some embodiments, the gaming system may generate the plurality of symbols for display on a set of reels in accordance with the reel strip set selected in block 630. As used herein, the random number generation may refer to pseudo-random or true-random number generation depending on the module used for the random number generation.

In one embodiment, the gaming system may cause a display device of the gaming system to display the plurality of symbols randomly generated from the selected reel strip set as indicated in block 650. In one embodiment, the gaming system may cause a video display device to display the plurality of symbols randomly generated in a manner as discussed above in relation to FIG. 3A. In one embodiment of a gaming system using physical reels fitted with video display technology, the gaming system may display the generated plurality of symbols in visible symbol display areas on each of the reels.

In one embodiment as shown in block 655, the gaming system evaluates the generated plurality of symbols across wagered pay lines for winning symbol combinations. In some embodiments, the gaming system evaluates the winning symbol combinations based on the pay lines wagered upon by a player. The gaming system may evaluate the player selected pay lines or default pay lines assigned for the play of the game. In one embodiment where the game uses reels, the gaming system determines an award amount based on winning symbol combinations formed across the reels on active (wagered upon) pay lines. For example, if a pay table associated with the gaming system indicated that at least three of the same "7" symbols is a winning symbol combination and awards a predetermined payout, the gaming system would evaluate the generated plurality of symbols for "7" symbols. If at least three "7" symbols were generated on adjacent reels and along a pay line, the gaming system may determine that the three "7" symbols are a winning symbol combination based on the predetermined pay table. For example, in the embodiment illustrated in FIG. 3B, the gaming system may evaluate the pay line 360 and determine that the three "7" symbols across symbol positions 370*b*, 380*b*, and 390*b* are a winning symbol combination based on the predetermined pay table. It should be appreciated that a pay table may include any suitable number of winning symbol combinations and payouts. In one embodiment, a pay table may indicate that as few as one symbol may be associated with a payout. Alternatively, two or more symbols may be used to form winning symbol combinations that result in a payout.

At block 660, the gaming system may update, with the processor, player's gaming credit balance in accordance with any award amount determined by the evaluation. As noted above, the blocks illustrated in FIGS. 6A-6B can be rearranged in any suitable order. As such, it should be appreciated that the gaming system may update the player's gaming credit balance at other suitable times.

In one embodiment, as indicated in block 665, the gaming system may receive a signal to end game play or "cash out" via an input device of the gaming system. In such a situation, the gaming system dispenses a value to the player, through a value dispenser, based on the player's gaming credit balance as illustrated in block 670 and operation 600 ends.

On the other hand, if the gaming system processor has not received a signal to end game play via the player input device, the process of operation 600 returns to block 615 via off page connector B. The gaming system may receive, via a player input device, a wager for another play of the game and continue operation 600 from block 615. However, in one embodiment, the wager may not be accepted if the player has fewer credits than the player's selected wager amount as shown in block 615.

Process flow 600 will now be described with the assumption that the previous game played on the gaming system resulted in a winning outcome.

During a next play of the game, the gaming system may use a processor of the gaming device to update a gaming credit balance. The credit balance may be updated in accordance with the player's wager amount as indicated in block 620. Some embodiments, the credit balance is not updated until a later time.

Block 625 illustrates one embodiment in which the gaming system may determine, using the processor, whether the last game played on the gaming system resulted in a non-winning outcome or whether the last game played on the gaming system resulted in a winning outcome. For discussion purposes, the last game played on the gaming system resulted in a winning outcome and process 600 moves to block 635.

Block 635 illustrates an embodiment in which a processor of the gaming system may randomly select a reel strip set from a second plurality of reel strip sets having a higher hit rate frequency than the hit rate frequency of the first plurality of reel strip sets associated with block 630 discussed above. In one embodiment, the processor of the gaming system, in block 635, may sequentially select a reel strip set from a second plurality of reel strip sets having a high hit rate frequency. In other embodiments, the processor of the gaming system, in block 635, may randomly select a reel strip set from a second plurality of reel strips sets having a high hit rate frequency.

In one embodiment, the hit rate frequency of a second plurality of reel strip sets may be 50%. A hit rate frequency of 50% means that over many plays of a gaming system utilizing the reel strip sets contained in the second plurality of reel strip sets, an average of fifty out of every one hundred plays of the game, the gaming system will generate a winning outcome. It should be appreciated that the hit rate frequency of 50% is merely for illustration purposes and any suitable hit rate frequency may be used.

It should be appreciated that the hit rate frequency percentages for both the first and second plurality of reel strip sets (10% and 50%, respectively) may be varied and may be higher or lower than the disclosed embodiments. It should be appreciated that in some embodiments, the gaming system may use more than two pluralities of reel strip sets. It should also be appreciated that in some embodiments, each reel strip set may include any suitable quantity of reel strips.

In some embodiments, the second plurality of reel strip sets having a high hit rate frequency may be predetermined reel strips. In other embodiments, the second plurality of reel strip sets having a high hit rate frequency may be randomly generated according to predetermined symbol sets, hit rate frequency constraints, and return to player value constraints. Once the gaming system selects the reel strip set, off page connector A refers to FIG. 6B to continue operation 600.

Turning now to FIG. 6B and off page connector A, block 640 illustrates one embodiment in which the gaming system may receive a request to initiate a play of a game. The request to initiate the play of the game on the gaming system may be received from a player via a player input device in communication with the gaming system. For example, the player may press a spin button on the gaming system to start the spinning reels (or randomly generating symbols using other methods discussed above) for the play of the game.

In one embodiment, the process flow 600 may continue from this point through blocks 645 to block 665 or 670 in the same manner previously described.

As can be appreciated, when a player achieves a non-winning outcome on a play of a game on the gaming system, there is a low probability the next game will result in a winning outcome. In one such embodiment, there is a 1 in 10 chance that a winning outcome will be generated on the next game because the gaming system will select the next reel strip set from the first plurality of reel strip sets having a low hit rate frequency (e.g., 10%). However, when a player achieves a winning outcome on a gaming system utilizing reel strips selected from a first plurality of reel strip sets having a low hit rate frequency, a subsequent play of the game causes the gaming system to utilize reel strip sets selected from a second plurality of reel strip sets having a high hit rate frequency. In one embodiment, the second plurality of reel strips sets have a hit rate frequency of 50% meaning there is a 5 out of 10 chance that a winning outcome will be generate on the next game. When the gaming system selects a reel strip set from the second plurality of reel strip sets having a high hit rate frequency, the gaming system is more likely to produce another winning outcome (because of the repetitive selection of a reel strip set having a high hit rate frequency) and to continue to produce winning outcomes. In time, however, the gaming system will generate a non-winning outcome. After a non-winning outcome is generated in a game using the high hit rate frequency reel strip set, the gaming system may select a reel strip set from the first plurality of reel strip sets having a low hit rate frequency for the next game. By varying the reel strips, which is to say by varying the game symbol sets, in this manner, the gaming system and method is more likely to produce a group or series of wins for a player. In this manner, player excitement and anticipation of the gaming system entering a winning streak or a "hot" phase producing winning outcomes is greatly enhanced.

Figure 7:
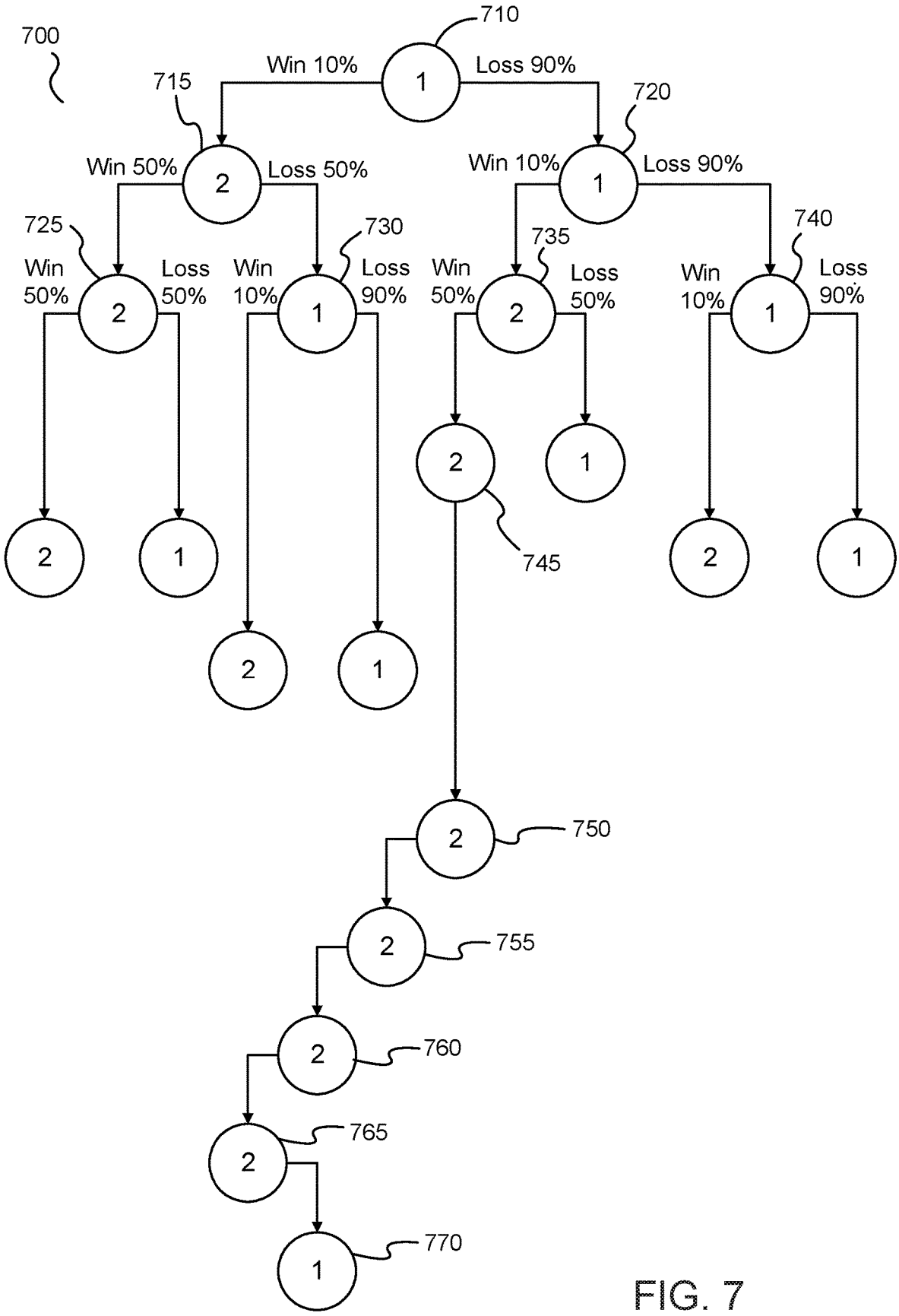
FIG. 7 is a graphical representation of a decision tree representation of one embodiment of the gaming system and method using variable symbol sets for variable win frequency gaming.

FIG. 7 is a graphical representation of a decision tree representation 700 of one embodiment of the gaming system and method of varying symbol sets for variable win frequency in a gaming system. In FIG. 7, each decision tree node represents a gaming outcome decision point (i.e., a play of a game on the gaming system). Game outcomes are represented by decision tree node branches. Decision tree node branches lead to the next game's outcome decision node. The probability of an outcome, in one embodiment, is indicated along certain decision tree node branches and is associated with the hit rate frequency of the reel strip sets utilized in outcome determination. For example, the numeral "1" in a decision tree node indicates that the gaming system selected a reel strip set from a first plurality of reel strip sets having a low hit rate frequency. A decision tree node having the numeral "1" also indicates that the game immediately prior to the decision tree node resulted in a non-winning outcome decision. In a like manner, the numeral "2" in a decision tree node indicates that the gaming system selected a reel strip set from a second plurality of reel strip sets having a high hit rate frequency, and that the game immediately prior to the decision tree node resulted in a winning outcome. In this manner, a randomly determined decisional outcome at any node affects the probability of a randomly determined decisional outcome and the next node. While hit rate frequency for the low hit rate frequency sets are shown at 10% and the high hit rate frequency sets are shown at 50%, any suitable hit rate frequencies may be used.

In one embodiment illustrated in FIG. 7, there are two possible decision tree outcomes at a decision tree node (i.e., the two possible outcomes of a particular game under play): a winning outcome (win) and a non-winning outcome (loss). Decision flows of non-winning outcomes will be described first followed by a description of decision flows of winning outcomes. The order is solely for ease of illustration.

Turning to FIG. 7 and decision tree entry node 710, the gaming system may select a reel strip set from a first plurality of reel strip sets having a low hit rate frequency as illustrated at 710. The numeral "1" in the decision tree node at 710 indicates that the gaming system selected a reel strip set from a first plurality of reel strip sets having a low hit rate frequency. It should be appreciated that in some embodiments, the first game played on a gaming system (system initialization) may default to using a reel strip set having a low hit rate frequency. In some embodiments, the gaming system may default to selecting a reel strip having a low hit rate frequency after the gaming system has been idle for a predetermined period.

In one embodiment, decision tree node 710 represents that the gaming system selected a reel strip set from a first plurality of reel strip sets having a low hit rate frequency and executed a play of a game. The gaming system displayed and evaluated the randomly generated symbols from the selected reel strip set. Because the gaming system used a low hit rate frequency reel strip set for the player of the game, the gaming system likely generated a non-winning outcome. This is because games played using a reel strip set having a low hit rate frequency result in a winning outcome in only 10% of game plays. Thus, a non-winning outcome occurs on a statistical frequency of 90% of game plays. This is indicated on FIG. 7 as "win 10%" and "loss 90%" on the decision tree node branches surrounding node 710. As noted above, the decision tree node branches illustrate the two possible outcomes of a play of a game on the gaming system. It should also be appreciated that the gaming system may have generated a winning outcome too. Decision tree node 720 represents the decisional aspects of the next play of the game after the gaming system generated a non-winning outcome at decision tree node 710. As explained in relation to blocks 625 and 630 of FIG. 6A, the gaming system may select a reel strip set from a plurality of reel strip sets having a low hit rate frequency when the previous game play resulted in a non-winning outcome. This is represented by the numeral "1" in decision tree node 720. In a similar manner as described above with respect to decision tree node 710, and for the same reasoning, it is 90% likely that a non-winning outcome occured as a result of the game play represented by decision tree node 720. When a non-winning outcome occurs, decision tree flow proceeds to decision tree node 740. Decision tree node 740 represents the decisional aspects of the next game played after the gaming system generated a non-winning outcome at decision tree node 720. At 740, the numeral "1" in the decision tree node at 740 indicates that, as above, the gaming system selected a reel strip set from a plurality of reel strip sets having a low hit rate frequency. In a similar manner as described above with respect to decision tree nodes 710 and 720, and for the same reasoning, in one embodiment it is 90% likely that a non-winning outcome occurred as a result of the game play represented by decision tree node 740.

It should be appreciated that game outcomes determined utilizing reel strip sets selected from the first plurality of reel strip sets (i.e., a "1" decision tree node) are more likely to result in a series of non-winning game outcomes than game outcomes determined utilizing reel strip sets selected from the second plurality of reel strip sets. In one embodiment, the series of games resulting in non-winning game outcomes may be lengthy. However, winning outcomes may occur, as indicated by decision tree flow to nodes 715, 725, and 735-765 of FIG. 7. Decision tree flow will now be described when a game outcome evaluation results in a winning outcome.

In one embodiment, the gaming system generated a winning outcome at decision tree node 710. The decision tree branch leads to decision tree node 715. Decision tree node 715 indicates that, in accordance with the process as explained in blocks 625 and 635 of FIG. 6A, the gaming system selected a reel strip set from a plurality of reel strip sets having a high hit rate frequency. This is indicated by the numeral "2" in the decision tree node 715. Stated differently, in one embodiment, the gaming system stopped selecting reel strip sets from the first plurality of reel strip sets having a low hit rate frequency and selected a reel strip sets from a second plurality of reel strip sets having a high hit rate frequency because of the prior winning outcome.

At decision tree node 715, it is equally likely that a winning outcome was generated after the gaming system displayed and evaluated the randomly generated symbols from the selected reel strip set. This is because games played using a reel strip set having a high hit rate frequency result in a winning outcome in 50% of game plays. Thus, a winning outcome occurs on a statistical frequency of 50% of game plays. This is indicated on FIG. 7 as "win 50%" and "loss 50%" on the decision tree node branches surrounding node 715. As noted above, the decision tree node branches illustrate the two possible outcomes of a play of a game on the gaming system. Decision tree node 730 represents the decisional aspects of the next game played after the gaming system generated a non-winning outcome at decision tree node 715. As explained in relation to blocks 625 and 630 of FIG. 6A, the gaming system may select a reel strip set from a plurality of reel strip sets having a low hit rate frequency when the previous game play resulted in a non-winning outcome. This is represented by the numeral "1" in decision tree node 730. In a similar manner as described above with respect to decision tree node 720, and for the same reasoning, it is 90% likely that the gaming system generated a non-winning outcome at decision tree node 730. When a non-winning outcome is generated, decision tree flow proceeds in a like manner as described above.

However, in one embodiment, it is equally likely that the gaming system generated a winning outcome at decision tree node 715. Decision tree node 725 represents the decisional aspects of the next game played after the gaming system generated a winning outcome the game of decision tree node 715. Decision tree node 725 indicates that, in accordance with the process as explained in blocks 625 and 635 of FIG. 6A, the gaming system selected a reel strip set from a plurality of reel strip sets having a high hit rate frequency when the previous game play resulted in a winning outcome. This is indicated by the numeral "2" in the decision tree node 725. The gaming system selected a reel strip set from a second plurality of sets of reel strip sets having a high hit rate frequency for a play of the game. It should be appreciated that game outcomes determined utilizing reel strip sets selected from the second plurality of reel strip sets (i.e., a "2" decision tree node) are more likely to result in a series of winning game outcomes than game outcomes determined utilizing reel strip sets selected from the first plurality of reel strips. In this manner, a series of winning outcomes may be generated (not shown) and increase the excitement for the player.

At decision tree node 720, there is a 10% probability that the gaming system generated a winning outcome. When a winning outcome is generated at decision tree node 720, the decision tree branch leads to decision tree node 735. Decision tree node 735 represents the decisional aspects of the next game played after a winning outcome is generated at the game of decision tree node 720. Decision tree node 735 indicates that, in accordance with the process as explained in blocks 625 and 635 of FIG. 6A, the gaming system selected a reel strip set from a plurality of reel strip sets having a high hit rate frequency. This is indicated by the numeral "2" in the decision tree node 735. The gaming system selected a reel strip set from a second plurality of sets of reel strip sets having a high hit rate frequency for a play of the game. As can be appreciated, in one embodiment, game outcomes determined utilizing reel strip sets selected from the second plurality of reel strip sets (i.e., a "2" decision tree node) are more likely to result in a series of winning game outcomes than game outcomes determined utilizing reel strip sets selected from the first plurality of reel strip sets. In this manner, a series of winning outcomes may be generated. In one embodiment, a series of winning outcomes are illustrated by decision tree nodes 745, 750, 755, 760, and 765. Each of the decision tree nodes 745, 750, 755, 760, and 765 contains the numeral "2", which, as described above, indicates that the gaming system selected a reel strip set from the second plurality of reel strip sets having a higher hit rate frequency. The numeral "2" also indicates that the game immediately prior to the respective node resulted in a winning outcome. The group or series of games with winning outcomes illustrated by decision tree nodes 745, 750, 755, 760, and 765 ends at decision tree node 765 where the gaming system generated a non-winning outcome.

As can be appreciated in the embodiment illustrated, while the gaming system generates non-winning game outcomes, the gaming system continues to select reel strip sets from the first plurality of reel strip sets having a low hit rate frequency until the gaming system generates a winning outcome. When a winning outcome is generated, the gaming system may select reel strip sets from the second plurality of reel strip sets having a high hit rate frequency. The gaming system will continue plays of the game by selecting reel strip sets from the second plurality of reel strip sets having the high hit rate frequency until a non-winning outcome is generated. After a non-winning outcome is generated, the gaming system may revert to selecting reel strip sets from the first plurality of reel strip sets having a low hit rate frequency. In this manner, the low hit rate frequency of the first plurality of reel strip sets may result in the creation of a random distribution of non-winning outcomes for the player. However, once a winning outcome is generated, the higher hit rate frequency of the second plurality of reel strip sets may result in the creation of a cluster or group of winning outcomes for the player that was not previously available to players. Players may come to recognize that a winning outcome may signify a winning streak or a "hot" phase is possible, thereby increasing player anticipation and excitement. The game as disclosed herein also creates a long winning experience for players that was not previously available.

Figure 8A:
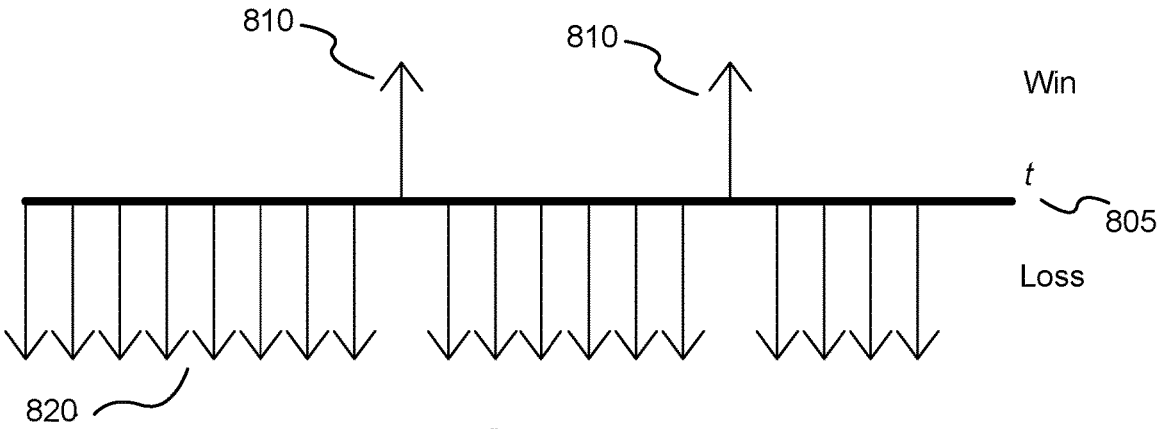
FIGS. 8A, 8B, and 8C are graphical representations of one embodiment of a timeline showing game outcomes over time on a gaming system utilizing variable symbol sets having different hit rate frequencies.
Figure 8B:
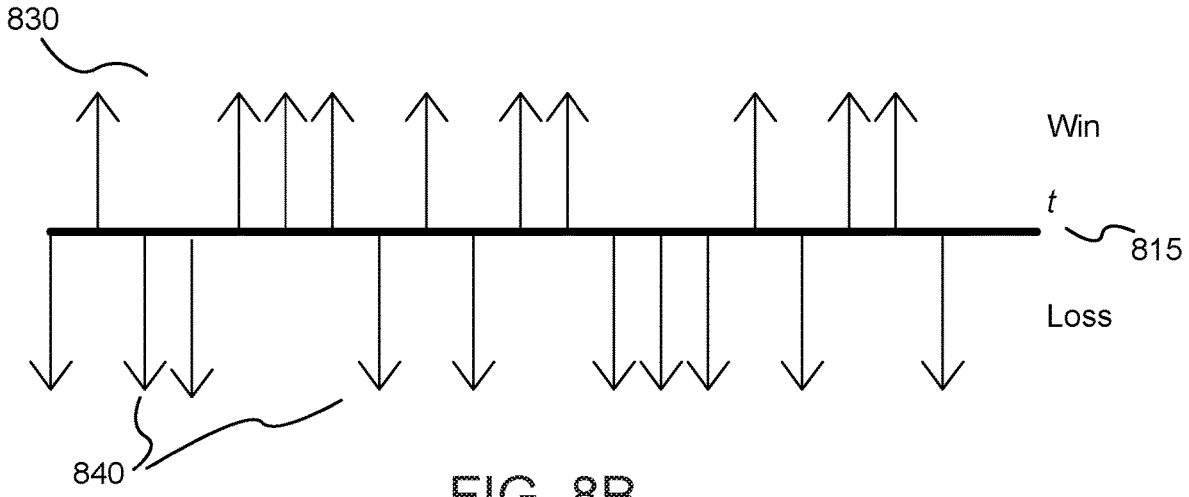
Figure 8C:
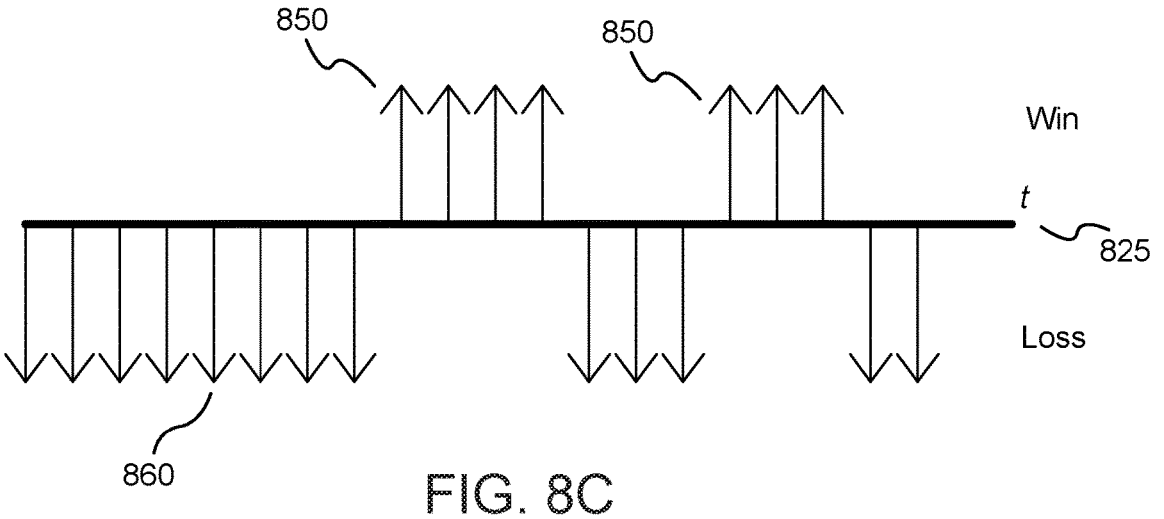

FIGS. 8A, 8B and 8C are graphical representation of timelines illustrating game outcomes over time on games played utilizing reel strips having different hit rate frequencies. FIG. 8C further illustrates the group or cluster effect of using reel strip sets with different hit rate frequencies for variable win frequencies for one embodiment of the disclosure. In FIGS. 8A, 8B, and 8C, winning outcomes of plays of a game on the gaming system are indicated by arrows pointing upward above the timeline t and non-winning outcomes are indicated by arrows pointing downward below timeline t.

FIG. 8A illustrates a representative series of 20 plays on a gaming system utilizing only reel strip sets selected from the first plurality of reel strip sets discussed above, having a low hit rate frequency. In one embodiment, the hit rate frequency of a first plurality of reel strip sets may be 10%. A hit rate frequency of 10% means that over many plays of a game utilizing the reel strip sets contained in the first plurality of reel strip sets, an average of ten out of every one hundred plays of the game will generate a winning outcome. Scaled for illustration, a hit rate frequency of 10% may be represented as two winning outcomes or wins 810 and 18 non-winning outcomes or losses 820 distributed along timeline 805. Viewed in this manner, it can be appreciated that in a gaming system utilizing reel strips having a hit rate frequency of 10%, the gaming system may generate a lengthy series of non-winning outcomes broken by an occasional winning outcome (or two). The long length of time between winning outcomes may not be satisfactory to players.

FIG. 8B illustrates a representative series of 20 plays on a gaming system utilizing only reel strip sets selected from the second plurality of reel strip sets having a high hit rate frequency. In one embodiment, a second plurality of reel strip sets may contain reel strips sets having a higher hit rate frequency when compared to the reel strip sets from the first plurality of reel strip sets. In one embodiment, the hit rate frequency of a second plurality of reel strip sets may be 50%. A hit rate frequency of 50% means that over many plays of a game utilizing the reel strip sets contained in the second plurality of reel strip sets, an average of fifty out of every one hundred plays of the game will generate a winning outcome. Scaled for illustration, a hit rate frequency of 50% may be represented as ten winning outcomes or wins 830 and ten non-winning outcomes 840 distributed along timeline 815. Viewed in this manner, it can be appreciated that the system could follow every non-winning outcome with a winning outcome. Further, in this embodiment, only a very small series of like outcomes would likely ever be generated and no anticipation for a winning outcome would develop as players would recognize that winning outcomes happen often. The frequent nature of winning outcomes may not be satisfactory to players.

FIG. 8C illustrates the group or cluster effect on the timing of winning outcome of a gaming system utilizing reel strip sets (i.e., symbol sets) with different hit rate frequencies for variable win frequency gaming as described for one embodiment of the disclosure. The gaming system of FIG. 8C initially selects reel strip sets from a first plurality of reel strip sets having a low hit rate frequency, as illustrated in FIG. 8A. As is illustrated in timeline 825 of FIG. 8C, using reel strip sets from the first plurality of reel strip sets provides a lower probability that a winning outcome will be generated and a higher probability that a series of non-winning outcomes will be generated. A series of non-winning outcomes 860 builds player anticipation that a winning outcome will be occurring soon. When a winning outcome is generated, the gaming system may vary the reel strip set selection and select a reel strip set from a second plurality of reel strip sets having a higher hit rate frequency than the reel strip sets from the first plurality of reel strip sets. Continuously using reel strip sets from the second plurality of reel strip sets in sequential plays of a game provides a high probability that a winning outcome will be followed by one or more winning outcomes. This aspect is illustrated by winning outcome series 850. As long as a winning outcome is generated, the gaming system may continue to select the reel strip set from the second plurality of reel strip sets having a high hit rate frequency. In this manner, a series of winning outcomes 850 may be generated and may provide great excitement to a player.

It should be appreciated that the likelihood of obtaining different quantities of winning outcomes can be varied in different embodiments. For example, in one embodiment, the gaming system may generate game outcomes from a reel strip set selected from the first plurality of reel strip sets for a first predetermined number of games. The gaming system may then generate game outcomes from reel strip sets selected from the second plurality of reel strip sets for a second predetermined number of games. The first predetermined number of games and the second predetermined number of games may be the same or different. In one embodiment, when a winning outcome triggers a selection of a reel strip set from a second plurality of reel strip sets, the gaming system may continue to select reel strip sets from the second plurality of reel strip sets for a predetermined number of games regardless of game outcome. Other variations are possible.

In the above described embodiments, reel strip sets are selected from a plurality of reel strip sets when a wager for a next play of the game is entered into the gaming system. In other embodiments, the reel strip sets may be selected at any other appropriate time. For example, the next reel strip set may be selected by the processor of the gaming system immediately after the evaluation, by the processor of the gaming system, of winning symbol combinations in block 655 of FIG. 6B.

It should be appreciated that the first plurality of reel strip sets having a low hit rate frequency value of 10% and the second plurality of reel strip sets having a high hit rate frequency value of 50% are for illustration of the principles of the varying reel strips for variable win frequency gaming system. In other embodiments, the first plurality of reel strip sets having a low hit rate frequency may be lesser or greater than 10% and the second plurality of reel strip sets having a high hit rate frequency value may be lesser or greater than 50%. A wide variety of reel strip sets having a wide variety of hit rate frequencies are contemplated.

In one embodiment, the gaming system and method utilizes reel strip sets selected such that the overall RTP amount for any particular gaming system remains constant, or substantially constant (i.e., within a designated predetermined range of return to player amounts) during a plurality of plays of a game. It should be appreciated that the number of sets of reel strip sets utilized by the system may be varied to generate a constant or substantially constant overall RTP amount. In a like manner, it should be appreciated that the symbol sets contained within each reel strip set may be varied to generate desired RTP values.

In some embodiments, after a winning outcome, the gaming system may set a certain quantity of next plays of a game as guaranteed wins. In some embodiments, the gaming system may randomly determine the quantity of next plays of a game as guaranteed wins. In some embodiments, the quantity of next plays of a game that are guaranteed wins is predetermined or randomly determined.

In some embodiments, the gaming system and method having varying reel strips for variable win frequency gaming described herein may be implemented as a base game on a gaming system. In other embodiments, the gaming system and method having varying reel strips for variable win frequency gaming described herein may be implemented in a base game for an additional wager. In yet other embodiments, the gaming system and method having varying reel strips for variable win frequency gaming described herein may be implemented in a bonus game not associated with a wager. In yet other embodiments, the gaming system and method having varying reel strips for variable win frequency gaming described herein may be implemented as a bonus game feature requiring a wager or an additional wager. In yet other embodiments, the gaming system and method having varying reel strips for variable win frequency gaming described herein may be a feature in both a base game and a bonus game, either with or without additional wagers.

In some embodiments, the gaming system pay tables may be the same across all reel strip sets. Alternatively, in some embodiments, the pay tables may vary dependent upon the reel strip set selected from the plurality of reel strip sets in any particular game.

In one embodiment, the gaming system and method having varying hit rate frequency reel strips (i.e., varying symbol sets) for variable win frequency gaming described herein may include a signifier to alert the player that the reel strip has been altered and the game is functioning in a 'hot' phase. The signifier may be a visual signifier provided on one or more of the display devices of the gaming machine. In one embodiment, the signifier may be an audio signifier. In some embodiments, the signifier may communicate the different hit rate frequency values or range of values utilized by the gaming system. In some embodiments, the signifier may communicate the hit rate value of the reel strip selected from a plurality of reel strips for a play of a game on the gaming system.

A number of embodiments of the invention have been described. Various modifications may be made without departing from the spirit and scope of the invention. For example, various forms of the processes and flows shown above may be used, with steps re-ordered, added, or removed. Accordingly, other embodiments are within the scope of the following claims.

We claim:

1. A gaming system comprising:

a display device, a value acceptor, a value dispenser, a memory device, and a processor, wherein the memory device stores program instructions that, when executed by the processor, cause the gaming system to:

establish a credit balance based at least in part on a value received by the value acceptor;

decrease the credit balance based on an amount of a wager;

determine an outcome status of a last concluded game played on the gaming system;

select symbol sets based upon the outcome status;

display, using the display device, a symbol display area including a plurality of randomly generated symbols from the selected symbol sets;

evaluate the plurality of randomly generated symbols for predetermined symbol combinations;

determine an award based upon the plurality of randomly generated symbols comprising at least one of the predetermined symbol combinations;

update the credit balance in accordance with the determined award; and issue a monetary value from the value dispenser based on the credit balance upon receipt of a cash out signal.

2. The gaming system of claim 1, wherein the program instructions further cause the gaming system to indicate, via a signifier, the selection of the symbol sets.

3. The gaming system of claim 2, wherein selecting the symbol sets comprises selecting the symbol sets from a plurality of different symbol sets, where groupings of symbol sets of the plurality of different symbol sets are associated with respective hit rate frequency values, and where the signifier indicates one of the hit rate frequency values.

4. The gaming system of claim 3, wherein the plurality of different symbol sets comprise first symbol sets and second symbol sets; and the hit rate frequency value of the second symbol sets is higher than the hit rate frequency value of the first symbol sets.

5. The gaming system of claim 4, wherein the gaming system selects the symbol sets from the second symbol sets when the outcome status is a winning outcome status.

6. The gaming system of claim 4, wherein the gaming system selects the symbol sets from the first symbol sets when the outcome status is a non-winning outcome status.

7. The gaming system of claim 2, wherein the signifier comprises one of a visual signifier, an audio signifier, and an audiovisual signifier.

8. The gaming system of claim 1, wherein the program instructions further cause the gaming system to:

select the symbol sets from a plurality of different symbol sets, wherein the plurality of symbol sets comprise first symbol sets associated with a first hit rate frequency value and second symbol sets associated with a second hit rate frequency value, where the second hit rate frequency value is higher than the first hit rate frequency value; and display randomly generated symbols from the selected symbol sets for a predetermined number of games.

9. The gaming system of claim 8 wherein the program instructions further cause the gaming system to:

select the symbol sets from the second symbol sets for a first predetermined number of games when the outcome status is a winning outcome status; and select the symbol sets from the first symbol sets for a predetermined number of games when the outcome status is a non-winning outcome status.

10. The gaming system of claim 9, wherein the first predetermined number of games and the second predetermined number of games are equal.

11. A method of operating a gaming system comprising:

receiving, by a processor via a value acceptor, a value;

establishing, by the processor of the gaming system, a credit balance based at least in part on the value received by the value acceptor;

decreasing, by the processor, the credit balance by a wager amount;

determining, by the processor, an outcome status of a last concluded game played on the gaming system;

selecting, by the processor, symbol sets based upon the outcome status;

displaying, by the processor on a display device of the gaming system, a symbol display area including a plurality of randomly generated symbols from the selected symbol sets;

evaluating, by the processor, the plurality of randomly generated symbols for predetermined symbol combinations;

determining, by the processor, an award based upon the plurality of randomly generated symbols comprising at least one of the predetermined symbol combinations;

updating, by the processor, the credit balance in accordance with the determined award; and issuing a monetary value, by the processor via a value dispenser of the gaming system, based on the credit balance upon receipt of a cash out signal.

12. The method of operating the gaming system of claim 11, further comprising:

indicating, via a signifier, the selection of the symbol sets.

13. The method of operating the gaming system of claim 12, further comprising:

selecting the symbol sets from a plurality of different symbol sets, wherein groupings of symbol sets of the plurality of different symbol sets are associated with a respective hit rate frequency value; and indicating, via the signifier, the hit rate frequency value.

14. The method of operating the gaming system of claim 13, wherein the plurality of different symbol sets comprise first symbol sets and second symbol sets; and the hit rate frequency value of the second symbol sets is higher than the hit rate frequency value of the first symbol sets.

15. The method of operating the gaming system of claim 14, further comprising:

selecting the symbol sets from the second symbol sets when a winning outcome status is determined.

16. The method of operating the gaming system of claim 14, further comprising:

selecting the symbol sets from the first symbol sets when a non-winning outcome status is determined.

17. The method of operating the gaming system of claim 11, further comprising:

selecting the symbol sets from a plurality of different symbol sets, wherein the plurality of different symbol sets comprise first symbol sets associated with a first hit rate frequency value and second symbol sets associated with a second hit rate frequency value, where the second hit rate frequency value is higher than the first hit rate frequency value; and randomly generating a plurality of symbols from the selected symbol sets for a predetermined number of games.

18. The method of operating the gaming system of claim 17, further comprising:

selecting the symbol sets from the second symbol sets for a first predetermined number of games when the outcome status is a winning outcome status; and selecting the symbol sets from the first symbol sets for a second predetermined number of games when the outcome status is a non-winning outcome status.

19. The method of operating the gaming system of claim 18, wherein the first predetermined number of games is equal to the second predetermined number of games.

20. A non-transitory computer-readable storage device having program instructions stored thereon, the program instructions being executable by a processor to cause a gaming system to:

establish a credit balance based at least in part on a value received by a value acceptor;

decrease the credit balance based on an amount of a wager;

determine an outcome status of a last concluded game played on a gaming system;

select symbol sets based upon the outcome status;

display, on a display device, a symbol display area including a plurality of symbols randomly selected from the selected symbol sets;

evaluate the plurality of randomly selected symbols for predetermined symbol combinations;

determine an award based upon the plurality of randomly selected symbols comprising at least one of the predetermined symbol combinations;

update the credit balance in accordance with the determined award; and issue a monetary value from a value dispenser based on the credit balance upon receipt of a cash out signal.

* * * * *